US012486605B2

(12) United States Patent
Patterson

(10) Patent No.: US 12,486,605 B2
(45) Date of Patent: Dec. 2, 2025

(54) DISTRIBUTED NETWORKED LAUNDRY MACHINE CONTROL AND OPERATION

(71) Applicant: Clarified Inc., San Francisco, CA (US)

(72) Inventor: Tristan Scott Patterson, San Francisco, CA (US)

(73) Assignee: Clarified Inc., San Francisco, CA (US)

( * ) Notice: Subject to any disclaimer, the term of this patent is extended or adjusted under 35 U.S.C. 154(b) by 25 days.

(21) Appl. No.: 18/589,163

(22) Filed: Feb. 27, 2024

(65) Prior Publication Data

US 2024/0287721 A1 Aug. 29, 2024

Related U.S. Application Data

(60) Provisional application No. 63/448,592, filed on Feb. 27, 2023.

(51) Int. Cl.

| | |
|---|---|
| ***D06F 34/05*** | (2020.01) |
| ***D06F 34/32*** | (2020.01) |
| ***D06F 93/00*** | (2006.01) |
| ***D06F 95/00*** | (2006.01) |
| ***D06F 103/02*** | (2020.01) |

(52) U.S. Cl.

CPC ..... *D06F 34/05* (2020.02); *D06F 34/32* (2020.02); *D06F 93/005* (2013.01); *D06F 95/004* (2013.01); *D06F 2103/02* (2020.02)

(58) Field of Classification Search

None

See application file for complete search history.

(56) References Cited

U.S. PATENT DOCUMENTS

| | | | | |
|---|---|---|---|---|
| 5,036,966 | A | 8/1991 | Kaspar et al. | |
| 5,734,150 | A | 3/1998 | Brown et al. | |
| 8,255,323 | B1 | 8/2012 | Casey et al. | |
| 8,958,846 | B2 | 2/2015 | Freeny, Jr. | |
| 9,092,768 | B2 | 7/2015 | Breitenbach et al. | |
| 9,898,884 | B1 | 2/2018 | Arora et al. | |
| 10,210,501 | B2 | 2/2019 | Low et al. | |
| 10,955,823 | B2 * | 3/2021 | Kessler | A47L 15/4445 |
| 2017/0243156 | A1 | 8/2017 | Janis et al. | |
| 2019/0028869 | A1 * | 1/2019 | Kaliner | G06F 21/62 |
| 2020/0125905 | A1 | 4/2020 | Bing et al. | |
| 2021/0108351 | A1 | 4/2021 | Patterson et al. | |
| 2021/0381152 | A1 | 12/2021 | Belveal et al. | |
| 2024/0229318 | A9 * | 7/2024 | Reeves | D06F 34/18 |

OTHER PUBLICATIONS

International Search Report and Written Opinion of the International Search Authority in international application No. PCT/US24/17522, mailed May 17, 2024.

* cited by examiner

*Primary Examiner* — Carlos Garcia

(74) *Attorney, Agent, or Firm* — Cognition IP, P.C.; Edward Steakley

(57) ABSTRACT

Methods, system and apparatus for the scheduling the retrieval, delivery and laundering of customer loads of laundry. The system may receive laundry service orders from customer, schedule couriers or delivery services for the transportation of bags of laundry from the customer to a washer located at a laundry facility. The washer may be located at a residential laundry facility or a commercial laundry facility. The system may provide the washer with instruction for performing the laundering tasks and track the progress of each load of laundry through the process by having the washer scan unique identifiers attached to the laundry bags, washing machines and dryers.

20 Claims, 32 Drawing Sheets

DISTRIBUTED NETWORKED LAUNDRY MACHINE CONTROL AND OPERATION

CROSS-REFERENCE TO RELATED APPLICATIONS

This application claims the benefit of priority of U.S. Provisional Application No. 63/448,592, filed on Feb. 27, 2023, and titled "DISTRIBUTED NETWORKED LAUNDRY MACHINE CONTROL AND OPERATION," which is hereby incorporated by reference in its entirety.

FIELD

The present invention relates generally to the integration of a chain of custody based laundering platform with laundry machines.

BACKGROUND

Gig workers are usually precluded from working from home. Many residential buildings now offer on-site laundry facilities that remain underutilized. Increasing the use of the on-site laundry facilities by bringing in outside laundry would be beneficial to profitability of the laundry facility and to a community of gig workers.

Current laundry services generally operate by having trucks pick up loads of laundry along a predetermined route and delivering the collected laundry to a central processing facility. Once at the central processing facility, the laundry is processed and loaded on the truck to deliver the processed laundry along the same route used in the collecting.

SUMMARY

The systems and methods described herein provide for the management of a laundry service platform. In some embodiments, the system may comprise a mobile application, operating on one or more client devices, wherein the mobile application may comprise a user interface and the one or more client devices may be operated by one or more customers and one or more washers. The system may also include one or more servers, connected by a network to the one or more client devices and one or more laundry facilities. The one or more laundry facilities may comprise one or more washing machines and one or more dryers.

In some embodiments, the one or more servers may be configured to receive, from a customer operating a client device, a laundry service order, wherein the laundry service order may be associated with one or more laundry bags. Each of the one or more laundry bags may hold one or more loads of laundry. Each of the one or more laundry bags may comprises a unique identifier.

In some embodiments, the server may be configured to calculate a washer score for each of the one or more washers, wherein the washer score may be based on a distance between the customer and the washer and a delivery time corresponding to transporting the one or more laundry bags associated with the laundry service order from the customer to the washer.

The server may further generate a ranked list of washers, wherein the ranked list of washers is a subset of the one or more washers and wherein the subset may be determined based on a washer score threshold value. The server may then generate an order offer notification for each of the washers in the ranked list of washers. The server may further transmit to each of the washers in the ranked list of washers the order offer notification. An order acceptance notification may be received from a first washer, wherein the first washer is one of the washers in the ranked list of washers and a first delivery service request may then be generated. The first delivery service request may comprise scheduling a courier to, retrieve from the customer and deliver to the first washer, the one or more laundry bags associated with the laundry service order.

In some embodiments, the mobile application may further be for scanning, by the first washer at a first laundry facility, the one or more laundry bags delivered by the courier. The washer my then select, through a washer user interface, a first load associated with a first laundry bag. The first washer may then scan a first washing machine at the first laundry facility, wherein the first washing machine is loaded with the first load. A first washing cycle on the first washing machine may then be initiated.

In some embodiments, a second load associated with a first laundry bag may be selected through the washer user interface followed by the scanning of a second washing machine at the first laundry facility, wherein the second washing machine is loaded with the second load. A second washing cycle on the second washing machine may then be initiated.

The system may then notify the first washer of the completion of the first washing cycle and second washing cycle. The washer may then scan the first washing machine containing the first load followed by scanning of a first dryer, wherein the first load may then be transferred from the first washing machine to the first dryer and wherein a first drying cycle may then be initiated on the first dryer.

The first washer may then scan the second washing machine containing the second load followed by scanning of a second dryer, wherein the second load may then be transferred from the second washing machine to the second dryer and wherein a second drying cycle may then be initiated on the second dryer.

The system may then notify the first washer of the completion of the first drying cycle and second drying cycle. The washer may then scan the first dryer containing the first load followed by scanning the first laundry bag, wherein the first load may be removed from the first dryer and folded before being placed in the first laundry bag.

The first washer may then scan the second dryer containing the second load followed by scanning the first laundry bag, wherein the second load may then be removed from the second dryer and folded before being placed in the first laundry bag along with the first load.

After all the loads are placed back into their original laundry bags, the system may then transmit, to the one or more servers, a completion notification, wherein the completion notification further comprises a second delivery service request, wherein the second delivery service request comprises scheduling a courier to, retrieve from the first washer and deliver to the customer, the one or more laundry bags associated with the laundry service order.

Further areas of applicability of the present disclosure will become apparent from the detailed description, the claims and the drawings. The detailed description and specific examples are intended for illustration only and are not intended to limit the scope of the disclosure.

BRIEF DESCRIPTION OF THE DRAWINGS

The present disclosure will become better understood from the detailed description and the drawings, wherein.

DETAILED DESCRIPTION

Figure 1A:
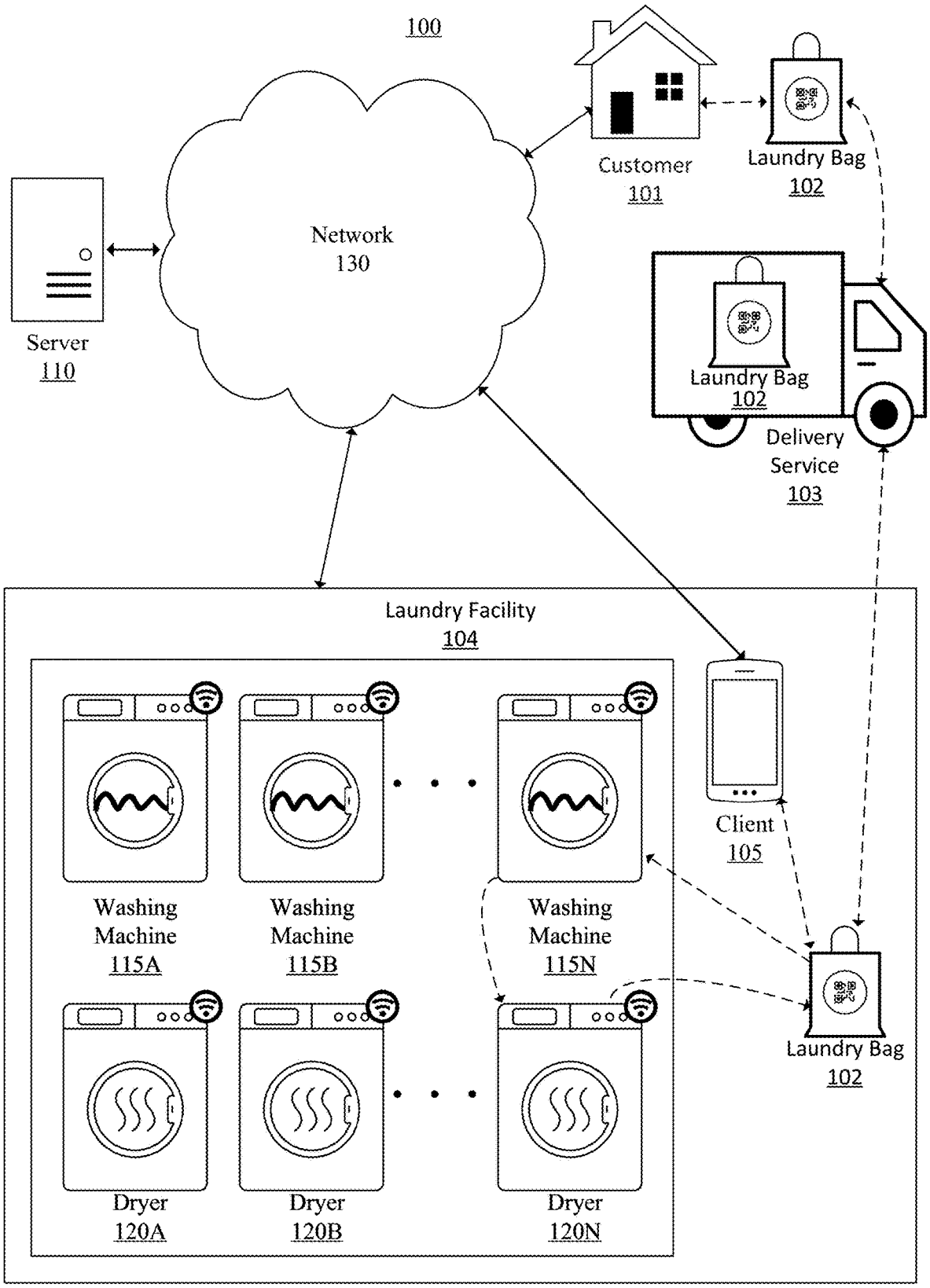
FIG. 1A is a diagram illustrating an exemplary environment in which some embodiments may operate.

In this specification, reference is made in detail to specific embodiments of the invention. Some of the embodiments or their aspects are illustrated in the drawings.

For clarity in explanation, the invention has been described with reference to specific embodiments, however it should be understood that the invention is not limited to the described embodiments. On the contrary, the invention covers alternatives, modifications, and equivalents as may be included within its scope as defined by any patent claims. The following embodiments of the invention are set forth without any loss of generality to, and without imposing limitations on, the claimed invention. In the following description, specific details are set forth in order to provide a thorough understanding of the present invention. The present invention may be practiced without some or all of these specific details. In addition, well known features may not have been described in detail to avoid unnecessarily obscuring the invention.

In addition, it should be understood that steps of the exemplary methods set forth in this exemplary patent can be performed in different orders than the order presented in this specification. Furthermore, some steps of the exemplary methods may be performed in parallel rather than being performed sequentially. Also, the steps of the exemplary methods may be performed in a network environment in which some steps are performed by different computers in the networked environment.

Some embodiments are implemented by a computer system. A computer system may include a processor, a memory, and a non-transitory computer-readable medium. The memory and non-transitory medium may store instructions for performing methods and steps described herein.

The following generally relates to a system for the managing and tracking of laundry service orders and laundry bags and loads associated with the orders. In some embodiments, the system and methods may allow for increased usage of laundry machines at laundry facilities. Each laundry facility may have a natural capacity based on the number of machines located at said facility. Demand at each facility may be based on the environment in which the facility is operated and the area that the facility is located in. For example, personal machines have a capacity and demand that is dependent upon the number of residents that are serviced by the machines. Shared resident machines may be located in a residential building or other multifamily dwelling. The demand for shared resident laundry machines may be relative to the number of people with access to the machines. Commercial machines may have a demand that can vary depending on location of the facility in which the commercial machines are operated and the needs of the community in that area.

In some embodiments, the systems and methods are configured to bring in outside loads to maximize the utilization of the laundry machines at a facility. External loads may be brought to a gig washer at a laundry facility by a third party logistics provider or any other delivery service. Loads may also be dropped off and picked up by customers. In some embodiments, the washer may also pick up the loads from a customer and drop them off after completion of the laundering.

In some embodiments, a mobile application or web application may be configured to allow washers to register as a provider, perform onboarding tasks, accept laundry service orders from customers, and track laundering procedures. In some embodiments, there may be separate applications for washers and customers. In other embodiments, a single application may be used for both washers and customers. If a single application is used for both washers and customers, different user interfaces and/or functionality may be enabled for each.

The system may allow for a customer to generate one or more laundry service orders. The customer may use a mobile device such as a smartphone, tablet, laptop or other electronic device with connectivity to the internet and sensors for scanning in one or more bags of laundry that are to be a part of the order being generated. The sensors may include cameras and/or RFID/NFC sensors. Unique identifiers, such as QR codes, barcodes and RFID/NFC tags, may be attached to each laundry bag. Upon scanning the unique identifier, the bag and load of laundry placed into the bad may be associated with the order. Each bag may hold one or more loads of laundry.

The customer may place the order after entering information related to bags and loads within the bags. Upon placing the order, a server may generate a washer score for one or more available washers in an area. The washers with a score above a predetermined threshold may be offered the order. In some embodiments, geofencing may be enforced to limit offering a job to washers that aren't physically at their home washing location or at an approved washing facility. A washer may be required to be at their home washing location or an approved washing facility to accept an order. This may guarantee that the washer will be available to receive the one or more bags associated with the order.

In some embodiments, the offers may be displayed to the washer through the application user interface on a washers device. A washer may choose to accept the order or skip it. If the order is accepted by a washer, a delivery service may then be dispatched to the customer's location to retrieve the one or more bags associated with the order. The delivery service may then transport the bag from the customer to the washer.

Upon arrival of the delivery service, the washer may be prompted to scan the one or more bags. After scanning the one or more bags, the user may then select, on the mobile application, a first bag to be processed. In some embodiments, the selection of a bag comprises selecting a bag ID associated with the physical bag. In some embodiments, if a bag holds more than one load, the mobile application may provide an addition load selection for the selected bag. Upon selection of the bag ID and an associated load to be processed, the user may then be prompted to scan a unique identifier of the machine in which the load is to be placed. The selected load may then be associated with the scanned machine, and control of the machine may be assigned to the washer. The washer may control the starting, stopping, locking, unlocking and settings of the machine through the mobile application user interface.

In some embodiments, one or more available machines at the washer's laundry facility may be scheduled at the time of acceptance of the order. The number of machines scheduled may be based the number of loads associated with the accepted order. The scheduling of the machines may further comprise sending a locking request to the scheduled machines. Control of the locked machines may then be transferred to the washer. The washer may then be able to unlock each of the one or more locked machines through the mobile application user interface. In some embodiments, after the washer selects the load and scans the machine, the machine may automatically be unlocked. After filling the machine with the associated load, the washer may initiate one or more washing/drying procedures through a selection on the mobile application user interface. In some embodiments, the washer may also be allowed to initiate the washing/drying procedure from the laundry machine itself. Parameters of the washing/drying procedures may be selected or input from the mobile application user interface and/or the laundry machine itself. In some embodiments, parameter selection may be based on one or more customer specified parameters received at the time of the order generation. The customer specified parameters may be associated with each bag and/or each load in the bag. Different parameters may be specified by the customer for different bags. In some embodiments, the customer specified parameters may be relayed to the laundry machine automatically, and the parameters for the washing/drying procedures set automatically based on the relaying.

In some embodiments, the system and methods may be configured to implement a scan pairing protocol to maintain chain-of-custody information. Scan pairs may be used to show the path in which each load makes its way through the laundry facility. For example, pairs such as bag/washer, washer/dryer, dryer/bag may be tracked to guarantee that each load removed from a bag is the same load that is put back into the bag after the laundering process is completed. In some embodiments, the bags may also be scanned at the time of handoff between the washer and the delivery service. This may be used to verify that the correct laundry bags have been picked up and are on their way to the customer. This may also be used to check to make sure that all bags associated with an order are accounted for before the departure of the delivery service.

For example, to begin a load of laundry, the washer may be required to scan the unique identifier on the bag that the load is in and then scan the unique identifier of the washing machine that the load will be inserted into. Upon completion of the washing cycle, the washer may then scan the unique identifier of the washing machine followed by scanning the unique identifier of the dryer that is to be used. In some embodiments, the washer may be instructed to move the load from the washing machine to a specific dryer after the scanning of the washing machine. The assigned dryer may be locked or otherwise inoperable until the washer scans the specified dryer. In other embodiments, the washer may choose an available dryer to move the washed load into. The scanning of the washing machine followed by the scanning of the dryer may be used to indicate that the load has been moved. Upon completion of drying the load, the washer may then scan the dryer, followed by scanning the bag in which the load will be placed upon completion of the folding of the load. After the bag has been scanned, the washer may then proceed to request that the bags be picked up for return to the customer. In some embodiments, the washer may be required to scan the bags again at the time of pickup to guarantee the correct bags have been returned to the customer. This may eliminate missing bags or bags going to the wrong customer.

In some embodiments, special instructions from the customer that are associated with a selected load may be displayed to the washer after they scan the bag but before they scan the desired washing machine. The special instructions may also be displayed to the washer after scanning the load out of a washing machine and before transferring the load to a dryer. In some embodiments, special instructions for washing may be displayed after scanning of the bag or after scanning of the washing machine. Similarly, special instructions for drying may be displayed after scanning out the load from the washing machine or scanning the load into a dryer.

Special instructions may be used to specify custom handling and washing/drying requirements for the associated load. For example, the customer may indicate that they wish the one or more loads in a bag to be separated based on color or material. The customer may also provide requests corresponding to the temperature at which to wash the one or more loads, the amount of detergent to use for each of the one or more loads, a temperature at which to dry the one or more loads, as well as folding and hanging instructions. In some embodiments, special instructions and requests may be made for individual items in the load.

For example, if there is a special instruction related to the drying process, a warning may be displayed to the washer as a reminder to follow the customer provided drying instructions. For example, the drying instructions may include hang drying one or more loads or one or more clothing items in the one or more loads or specifying drying temperature and or times for each load or for one or more clothing items.

In some embodiments, the special instructions may be entered in a free text field that is associated with one or more customer loads. In other embodiments, there may be selectable options that a customer may choose to provide the desired instructions. For example, there may be selectable options displayed to the customer when before the order is placed. The selectable options may include detergent type, amount of detergent, use of fabric softener, washing temperature, washing cycle (gentle, delicates, sanitary, Active Wear, Whites, colors, towels, quick wash, etc.), soil levels, extra rinse, drying temperature, drying cycle (regular, timed, automatic, delicate, gentle, permanent press, steam, air fluff, etc.), hang drying and/or folding style.

In some embodiments, special instructions may be modified or added after the order has been placed but before the laundering has begun.

In some embodiments, the customer may be provided with a list of washers that are available. The customer may then select a washer that they wish to send their laundry to for processing. The available washers may be listed based on an average washer rating, estimated time of completion, or other metrics chosen by the customer. In some embodiments, washers may also offer additional services that may be selected by the customer. Additional services may include dry cleaning, ironing, starching or other laundering processes.

In some embodiments, laundry facilities may be operated on a demand based pricing model. The price for laundry services may be increased based off of the price to operate the one or more laundry machines at the higher demand based price. In other embodiments, the pricing may be based on time of day and/or turnaround time for the customer's order.

FIG. 1A is a diagram illustrating an exemplary environment in which some embodiments may operate. The diagram shows an example of a laundry service control environment 100A for receiving laundry service requests from customers, tracking of laundry loads, receiving laundry, laundering of the received laundry, returning of the processed laundry to the customer that places the laundry service request, in accordance with some embodiments. The example shown includes customer 101, laundry bag 102, delivery service 103, laundry facility 104, client 105, server 110, washing machines 115A-N, dryers 120A-N and network 130.

Customer 101 may be any person, business or other entity. The customer may be provided with an application and user interface which provides the customer with the ability to generate one or more laundry service orders. The customer may use a client device 105 or other device to generate the one or more laundry service orders. In some embodiments, to generate the order, the customer may be prompted to place clothing in one or more uniquely identifiable laundry bags ("bags") 102.

Delivery service 103 may be a third party service that provides pickup of one or more bags 102 from customer 101, transport of the one or more bags 102 to a user (hereinafter "washer") at laundry facility 104, pickup of processed bags 102 from the washer at the laundry facility 104 and the delivery of the processed bags to the customer 101.

Bags 102 may be filled and carry one or more loads of laundry ("loads"). Loads represent a unit of laundry that is to be processed. In some embodiments, the bags 102 may be labeled with one or more unique identifiers. The unique identifiers may include barcodes, QR codes, RFID tags, other scannable unique identifiers or combination thereof, attached to the one or more bags 102. In some embodiments, the bags 102 may be customer supplied, and either reusable or disposable. User supplied bags 102 may be labeled by the customer by attaching a supplied QR code, barcode or RFID tag to the bag. The supplied QR code or barcode may be preprinted and provided to the customer 101 for use with their own bags 102 or provided electronically to the customer 101 to be printed by the customer. RFID tags may also be provided to the customer for attachment to the bags 102. Bags 102 may be of different sizes. In some embodiments, the bags 102 may hold two or more loads of laundry. In other embodiments, a bag 102 may be sized to only allow a single load per bag.

Laundry facility 104 may comprise one or more washing machines 115A-N and dryers 120A-N. In some embodiments, the laundry facility may be a residential washing facility located in a building that may house a plurality of people and/or customers 101. The laundry facility 104 may also be a commercial facility with a plurality of washing machines 115A-N and dryers 120A-N. In some embodiments, the laundry facility may be a personal laundry facility, only accessible by a single customer.

Server 110 may be an example of, or include aspects of, the corresponding element or elements described with reference to FIG. 1B. Client 105 may be an example of, or include aspects of, the corresponding element or elements described with reference to FIG. 1C. Washing machine 115 may be an example of, or include aspects of, the corresponding element or elements described with reference to FIG. 1D. Dryer 120 may be an example of, or include aspects of, the corresponding element or elements described with reference to FIG. 1D.

Client device 105 may be one or more personal computers, personal digital assistants (PDAs), tablet computing devices, laptop computers, smart phones, e-readers or other systems capable of operating a standalone application or web-based application in a browser.

Figure 1B:
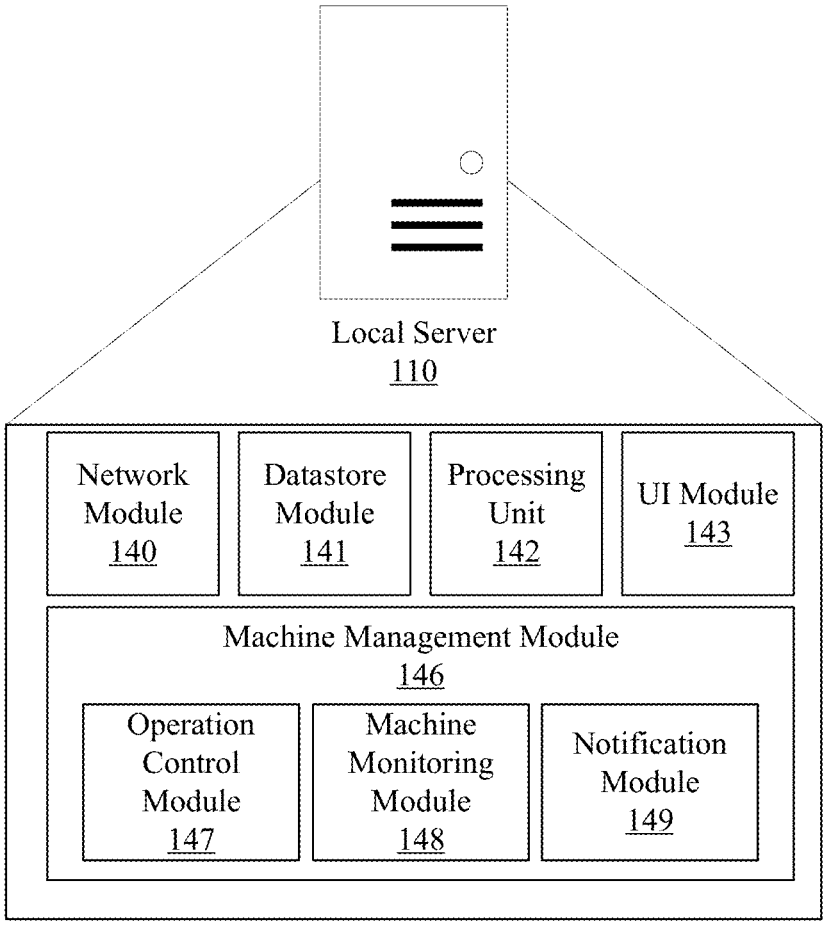
FIG. 1B is a diagram illustrating an exemplary server in accordance with aspects of the present disclosure.

Server 110 may be any computing device(s) capable of executing the operation of the control system, including the operation of the modules of FIG. 1B. Server 110 may be connected through a network 130 to customer 101, delivery service 103, laundry facility 104, client device 105, washing machines 115A-N and dryers 120A-N.

Network 130 may be an intranet, internet, mesh, LTE, GSM, peer-to-peer or other communication network that allows the server 110 to communicate with customer 101, delivery service 103, laundry facility 104, client 105, washing machines 115A-N and dryers 120A-N.

FIG. 1B is a diagram illustrating an exemplary server 110 in accordance with aspects of the present disclosure. Server 110 may comprise a network module 140, datastore module 141, processing unit 142, UI module 143 and machine management module 146.

Network module 140 may transmit and receive data from other computing systems via a network. In some embodiments, the network module 140 may enable transmitting and receiving data from the Internet. Data received by the network module 140 may be used by the other modules. The modules may transmit data through the network module 140.

Datastore module 141 may be a storage media, such disk drives, solid state drives, tape drives, RAM, ROM, or anything other media that can be read from and written to. The datastore module 141 may comprise one or more structured or unstructured databases or other data structures. The datastore module 141 may be configured to store information received from customer 101, delivery service 103, laundry facility 104, client 105, washing machines 115A-N, dryers 120A-N, network module 140, processing Unit 142, UI module 143, machine management module 146 or other sources of data connected to the server. Datastore module 141 may be connected to a cloud based or network-area storage solution. Datastore module 141 may store user information, machine information, facility information, machine learning models, predictive models, maintenance logs, energy and water consumption logs, customer information, laundry service orders, chain of custody information for laundry bags, as well as time-series data on the operation of the machines and their sensor readings.

Processing unit 142 may be configured to receive information and instructions from other modules in the server 110 and perform functions corresponding to the instructions and information received.

UI module 143 may generate one or more graphical user interfaces ("GUIs"). The one or more GUIs may include a customer GUI and a washer GUI. In some embodiments, the same GUI may be generated and used by both the customer 101 and the washer. A request for a GUI from a client 105 or customer 101 may be received by the UI module 143. The UI module 143 may then access customer information, washer information, laundry facility information, delivery service information, laundry service order information or any data related to the receiving, processing, tracking of a laundry service order.

Machine management module 146 may comprise operation control module 147, machine monitoring module 148 and notification module 149. The machine management module 146 may receive client 101 selection and/or washer selections from client devices 105 over network module 140 and information relating to the selection from the datastore module 141. Machine management module 146 may be configured to calculate, receive or retrieve a duration of the desired machine operation. The duration of the machine operation may be determined based on the selected machine, service type, one or more operational parameters selected by the washer and the amount paid by the washer. The cost of the machine operation may also be based on the selected machine, service type, one or more operational parameters selected by the washer and the desired duration of operation for the machine. For example, a washer may choose a specified amount of time for a dryer to operate instead of choosing an amount to pay. The system may determine the cost based at least partly on the duration and the duration based at least partly on the amount paid.

The machine management module 146 may allow for transfer of operational responsibility to a washer and controlled by a washer's interaction with a GUI on client 105.

Operation control module 147 may communicate and manage individual washing machines 115 or dryers 120. Operation control module 147 may initiate a timer corresponding to the duration of the chosen machine operation. The status of the machine may be changed from available to unavailable upon receiving payment confirmation, initiating the timer, or the start of the machine operation. Operation control module 147 may also receive, from the client device 105, a request to start operation of the machine. Alternatively, the washer may select operational parameters from the machine itself and choose to start operation of the machine. The selections made by the washer at the physical machine and the initiating the operation of the machine through physical interaction with the machine may be transmitted to the operation control module 147.

Operation control module 147 may also receive, from the client device 105, requests to engage or disengage (lock or unlock) a locking mechanism on the selected machine. The lock/unlock request is transmitted from the operation control module 147 to the washing machine 115 or dryer 120. A locking status of the chosen machine may then be updated by the operation control module 147, and displayed on the client device 105.

Operation control module 147 may also receive requests to add time to the timer, to extend the duration of operation of the machine. Along with the request, the operation control module 147 may receive an additional payment confirmation associated with the received request. The operational control module 147 may then send a request to the washing machine 115 or dryer 120 to add time to the duration of the operation.

Machine monitoring module 148 may receive information from one or more machines. The machine monitoring module 148 may track the usage of each machine. Energy consumption, operating parameters, operational status, lock status, and sensor readings may all be monitored and tracked. The information obtained from the machine monitoring module 148 may be analyzed to determine if a machine is in an error, failed or malfunctioning state. In some embodiments, the information obtained from the machine monitoring module 148 may be used in the training of one or more machine learning models.

Notification module 149 may generate notifications to be sent to the client device 105. The notification module 149 may send and receive information from the client device 105, network module 140, datastore module 141, operation control module 147, machine monitoring module 148 or combination thereof. The notification module 149 may be configured to send a notification to the client device 105 once the timer on the operation reaches a predetermined level (time remaining), the operation has been completed successfully or there is no time left on the timer. The determination that the operation has been completed successfully may be based on time and/or sensor readings. Based on sensor data, it may be determined that the operation has successfully completed even if there is still time remaining on the timer. For example, a washer may be using a dryer to dry a load of clothing. The time required to completely dry the load of clothing is determined by a number of different variables. The size of the load, material of the articles making up the load, temperature of the dryer drum, temperature of the air entering the dryer, humidity level of the air entering the dryer and many other environmental, load, and machine variables can all affect the drying time of the load.

When the timer reaches the threshold, a notification may be sent to the client device 105 to inform the washer that the time remaining on the operation is running out. The notification may also inform the washer on the status of the operation, such as if the operation has been completed or will complete before time runs out (based on sensor data), if additional time may be needed to complete the operation or an estimated/predicted amount of additional time and cost to complete the operation. The washer may be provided with an option to pay for additional time to be added to the operation and timer of the operation. The washer may select an amount of time to add or an amount of money to add. When the washer selects the amount of time to add, the cost of the addition may be calculated and presented to the user for payment. When the washer selects the amount of money to add, the amount of additional time may be calculated and displayed for the washer on the client device 105.

If a washer chooses to add additional time and/or money to the operation on the machine, they may submit an additional payment, resulting in addition of time to the operation of the machine and the timer for the operation.

Figure 1C:
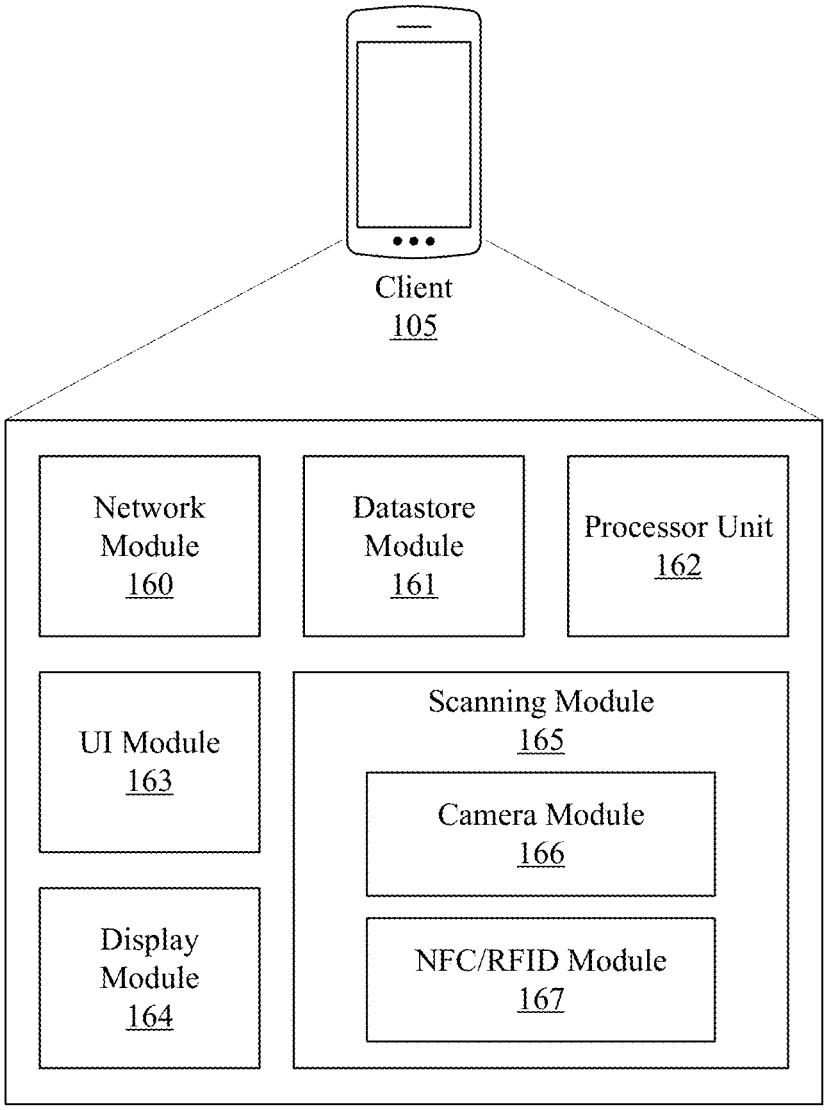
FIG. 1C is a diagram illustrating an exemplary client device in accordance with aspects of the present disclosure.

FIG. 1C is a diagram illustrating an exemplary client device 105, in accordance with aspects of the present disclosure. Client 105 may comprise network module 160, datastore module 161, processor module 162, UI module 163, display module 164 and scanning module 165.

Network module 160, datastore module 161 and processor unit 162 may be the same or similar to those described in reference to FIG. 1B (network module 140, datastore module 141 and processing unit 142). UI module 163 may generate a washer interface to allow a washer to control all aspects of their laundry session. UI module 163 may send and receive information through the network module 160. The UI module 163 may receive facility and machine information through network module 160. The facility and machine information may be used by the UI module to display a list of available and unavailable machines. The machines in the list may be selectable. Information regarding current operations being performed by the machines may be displayed to the washer. The UI may display operational parameters to be selected by the washer and associated with a selected machine. The UI module 163 may send selections from the washer, to the server 110. The selections and requests generated by the washer in the UI module 163 may be sent to the machine itself, through the server or directly. Information displayed on the interface may be updated based on selections made on the machine itself. The UI module 163 may be used to trigger lock and unlock functions at the machine, engaging and disengaging a locking mechanism. UI module 163 may be in communication with display module 164, allowing the display module to render the interface on the device.

Display module 164 may be a touch-screen display, a head-up display, a head-mounted display, an optical see-through display, an optical see-around display, a video see-through display, a flat-panel display, a light-emitting diode (LED) display, an electroluminescent display (ELD), an electrophoretic display (EPD or electronic paper), a liquid crystal display (LCD), an organic LED (OLED) display, an active-matrix organic light-emitting diode display or any other type of display.

Scanning module 165 may comprise camera module 166 and NFC/RFID module 167. The scanning module 165 may be used for the scanning of one or more bags 102, one or more washing machines 115A-N and one or more dryers 120A-N during the processing of a laundry service order.

Figure 1D:
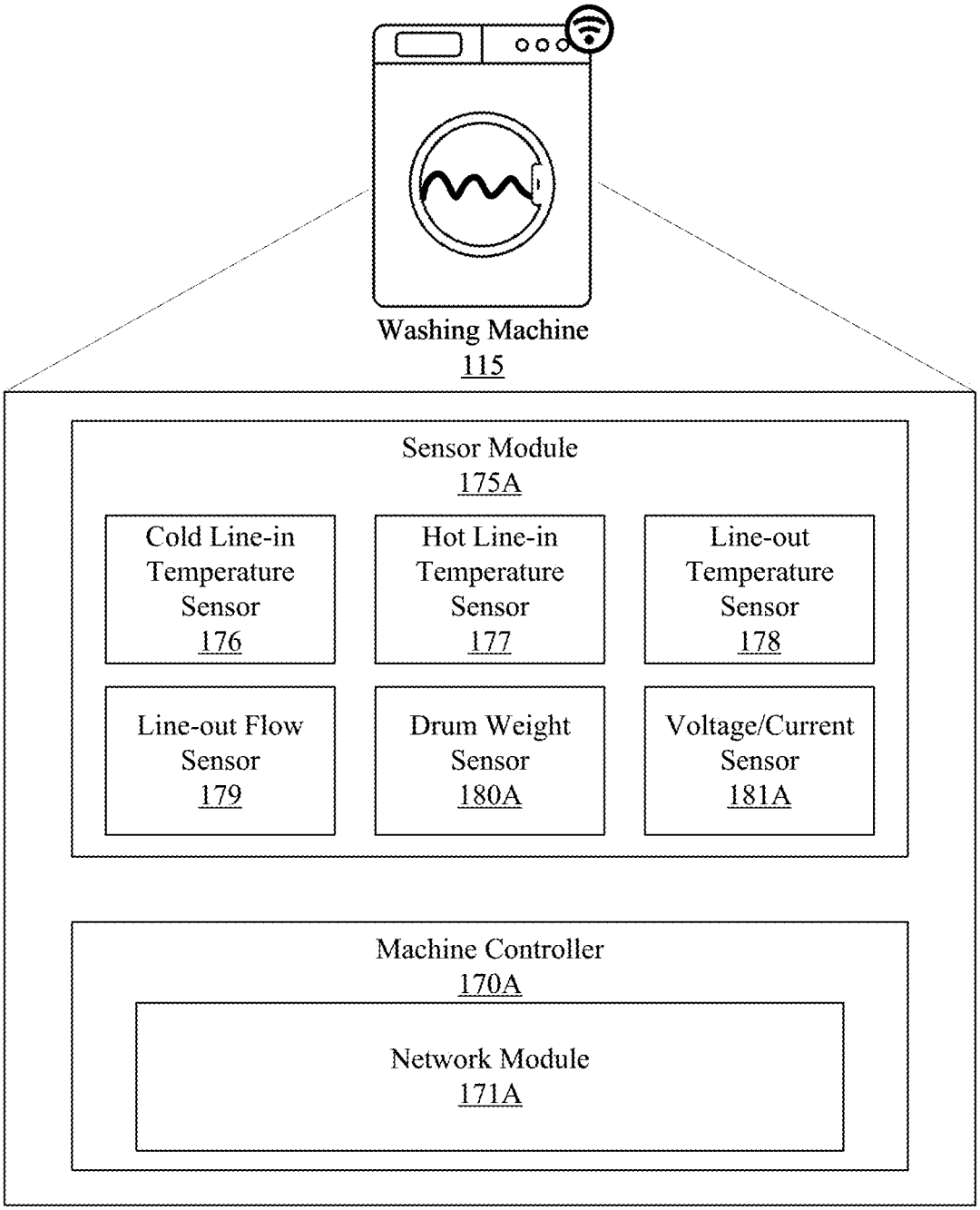
FIG. 1D is a diagram illustrating an exemplary washing machine in accordance with aspects of the present disclosure.

FIG. 1D is a diagram illustrating an exemplary washing machine 115, in accordance with aspects of the present disclosure. Washing machine 115 may comprise a machine controller 170A, network module 171A and sensor module 175A. The network module 171A may be similar to that described with regard to FIGS. 1B-1C.

Machine controller 170A may be configured to receive operational parameters from the operation control module 147 and cause the machine to perform the desired functions. The washing machine controller 170A may directly control all aspects of the machine's operation. In some embodiments, the machine controller 170A may be a board that is retrofitted to the washing machine to enable control, management and monitoring of the machine.

Sensor module 175A may comprise cold line-in temperature sensor 176, hot line-in temperature sensor 177, line-out temperature sensor 178, line-out flow sensor 179, drum weight sensor 180A and voltage/current sensor 181A. Cold line-in temperature sensor 176 and hot line-in temperature sensor 177 measure the temperature of water entering the washing machine. The line-out temperature sensor 178 measures the water temperature as it is being drained from the washing machine. Line-out flow sensor 179 may measure the flow rate of water as it leaves the washing machine. Drum weight sensor 180A may be used to measure the weight of the load at multiple times during the washing cycle. The initial weight, weight during wash, weight after first draining, weight during rinse and weight after final draining may all be determined and stored for analysis. Additional readings from the drum weight sensor 180A may be taken and stored. There may be more or less stages during a washing cycle and the weight readings at the start, during and after each may be needed for analysis. Voltage/current sensor 181A may be continually read during operation of the machine. The voltage/current sensor 181A may be used to determine efficiency of the machine and to help in detecting malfunctioning machines.

Figure 1E:
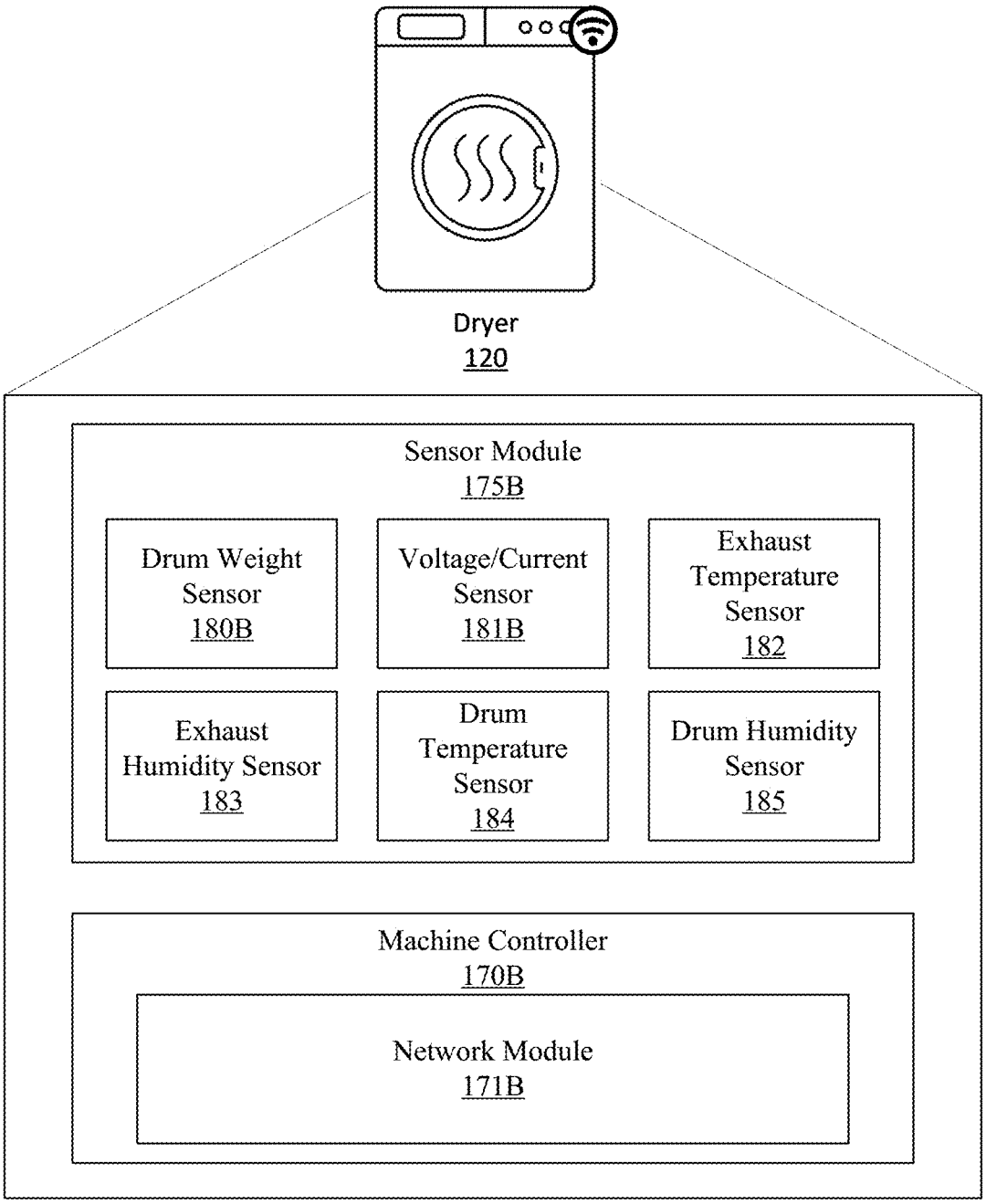
FIG. 1E is a diagram illustrating an exemplary laundry dryer in accordance with aspects of the present disclosure.

FIG. 1E is a diagram illustrating an exemplary dryer 120, in accordance with aspects of the present disclosure. Dryer 120 may comprise machine controller 170B, network module 171B and sensor module 175B. The network module 171B may be similar to that described with regard to FIGS. 1B-1D.

Machine controller 170B may be the same or similar to that of the same component described in regard to FIG. 1D. Machine controller 170B may be configured to relay commands and operational parameters to the machine, or control the machine directly as described with regard to machine controller 170A of FIG. 1D.

The sensor module 175B may comprise drum weight sensor 180B, voltage/current sensor 181B, exhaust temperature sensor 182, exhaust humidity sensor 183, drum temperature sensor 184 and drum humidity sensor 185. The drum weight sensor 180B and voltage/current sensor 181B are the same or similar to that described in regard to FIG. 1D. The exhaust temperature sensor 182, exhaust humidity sensor 183, drum temperature sensor 184 and drum humidity sensor 185 may all continually take readings during the operation of the dryer. Monitoring the temperature of the exhaust and the temperature of the drum, and the time required to reach those temperatures may be used to determine how efficiently the machine is operating. Deviations from heating efficiency may require preventative maintenance to reduce the risk of failure and downtime. The heating efficiency may take into consideration the power drawn by the machine, weight of the load, temperature and humidity in the drum and temperature and humidity of the exhaust. Additional information may be used from the washing machine to estimate the amount of water still absorbed by the laundry (difference between initial laundry weight and the laundry weight as measured either at completion of the washing operation or as loaded into the dryer). The amount of water in the laundry may be calculated as a hydration percentage of weight. The hydration percentage may be used in determining a suggested duration of operation to completely dry the laundry at the desired operational parameters.

Heating efficiency may be more accurately determined, and predictions on drying times for a load may be automatically determined by incorporating the calculated hydration percentage into the calculations. For example, users may regularly try to fit their clothing into as few washing machines as possible, and then split the loads to speed up drying. Therefore, there are situations where each load from a single washing machine is dried in two or more dryers. Each dryer may be able to calculate the exact amount of time required to dry each load by taking into consideration the hydration percentage. With no prior knowledge of the load being dried, it becomes more difficult to predict the operation time required because the amount of water that needs to be removed from the clothing is unknown. Without prior knowledge, a small load of very damp laundry and a large load of fairly dry laundry may weigh the same, but will take drastically different amounts of time to dry. When the hydration percentage is known for the laundry, a machine may more accurately estimate the amount of water present at the start of the drying operation and therefore make a more accurate prediction of operation duration.

The exhaust temperature and exhaust humidity may also be used to estimate how much water remains in the laundry and determine completion of a drying operation. Efficiency trends for a machine may be used to determine failures or malfunctions. Time to reach the desired operation temperature, how well the temperature is maintained, the maximum temperature reached, and rate of temperature drop after completion may all be analyzed to determine malfunctions or degradation of functionality.

Figure 2A:
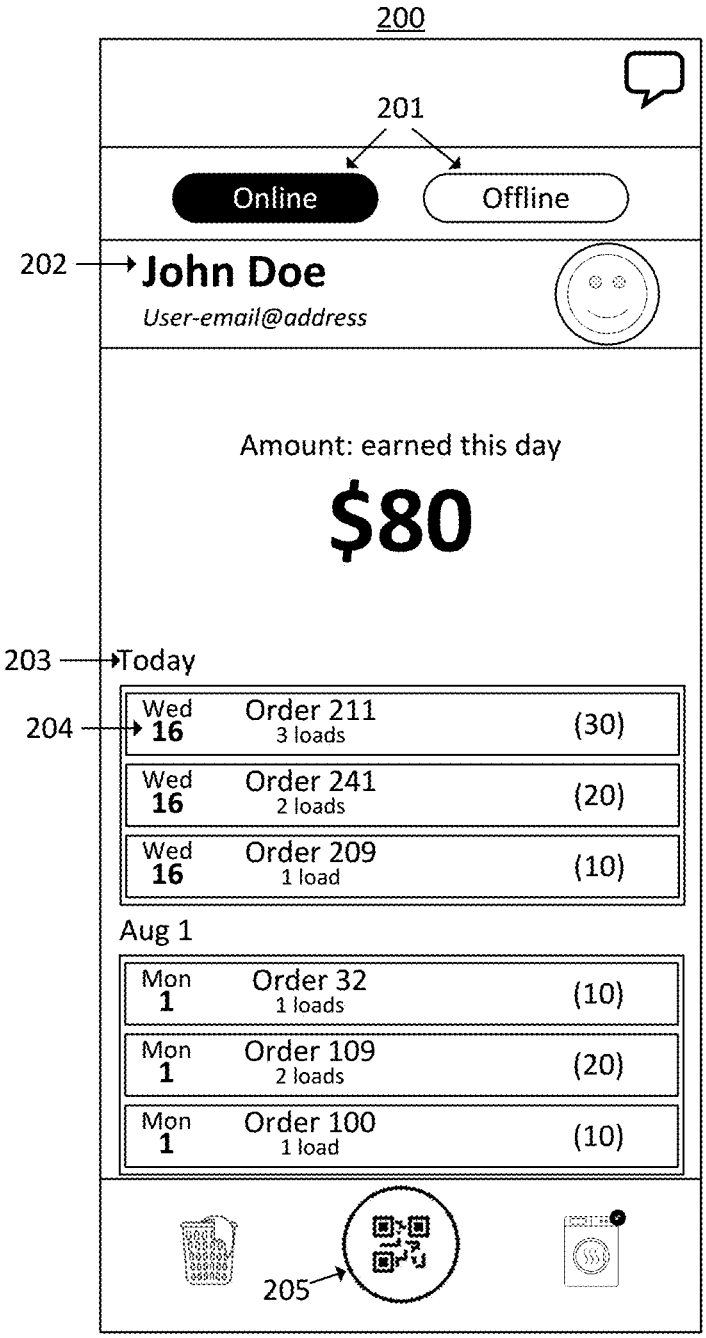
FIG. 2A is a diagram illustrating an exemplary graphical user interface for a washer service in accordance with aspects of the present disclosure.
Figure 2B:
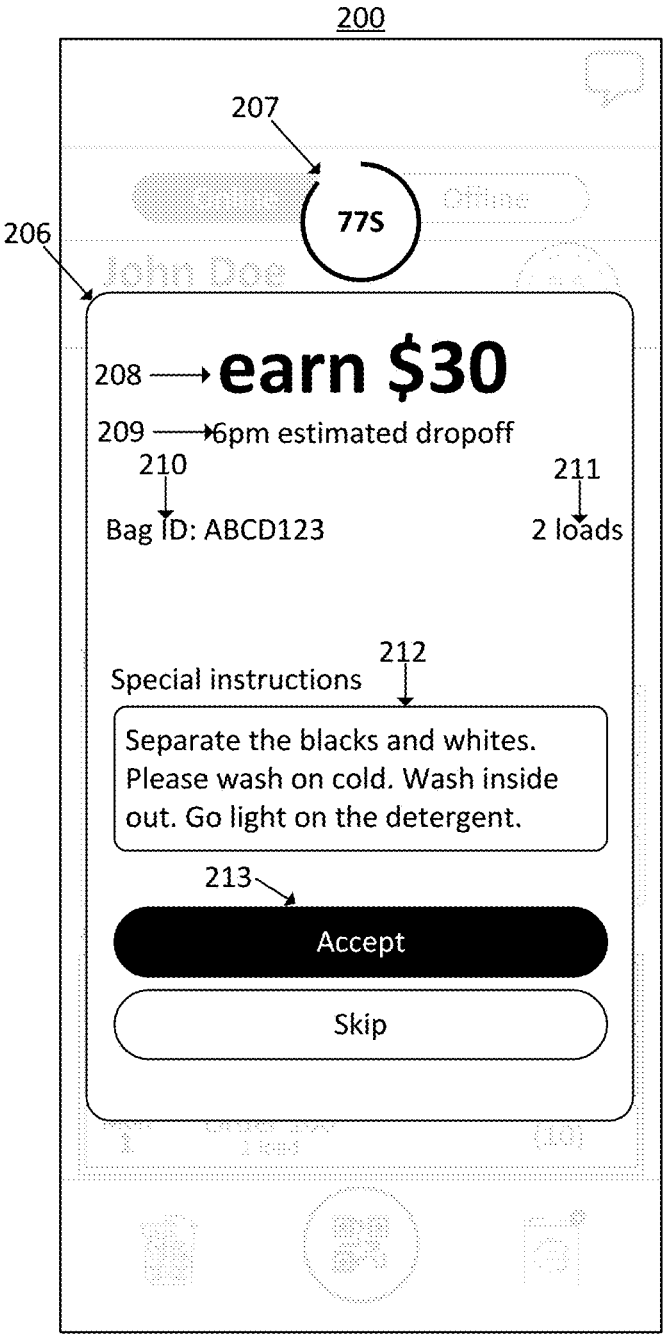
FIG. 2B is a diagram illustrating an exemplary graphical user interface for a washer service in accordance with aspects of the present disclosure.
Figure 2C:
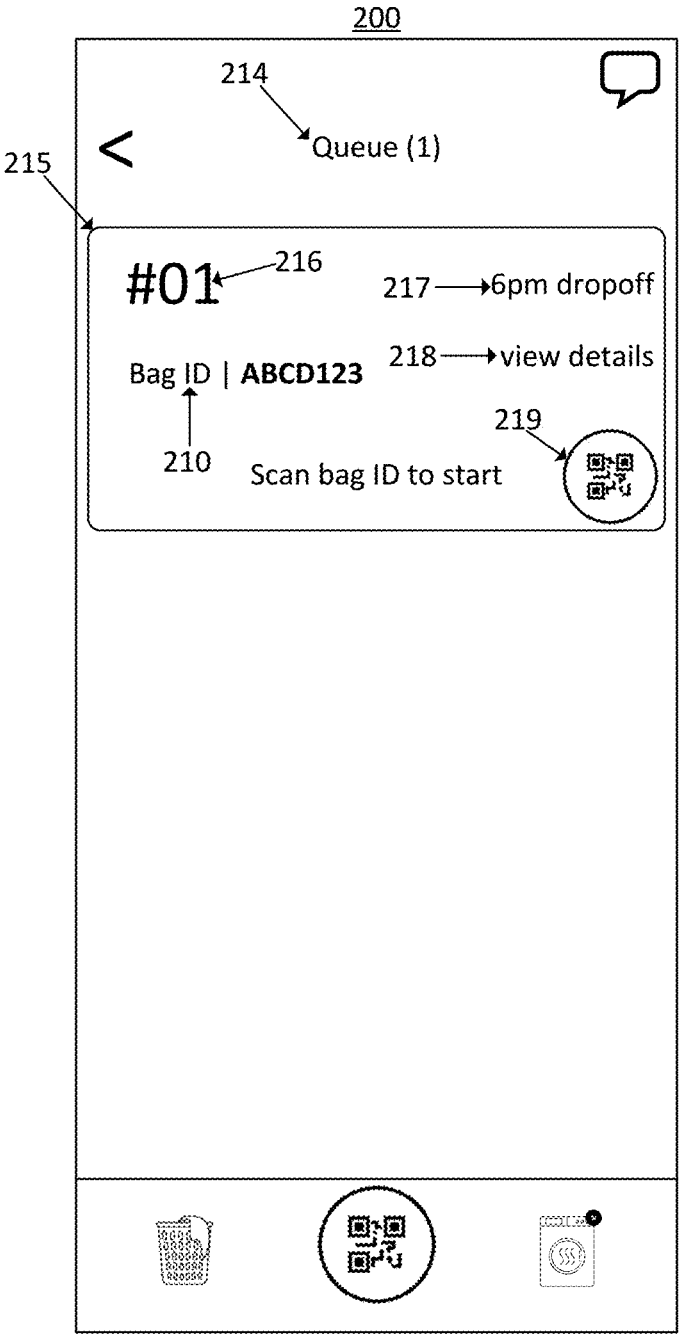
FIG. 2C is a diagram illustrating an exemplary graphical user interface for a washer service in accordance with aspects of the present disclosure.
Figure 2D:
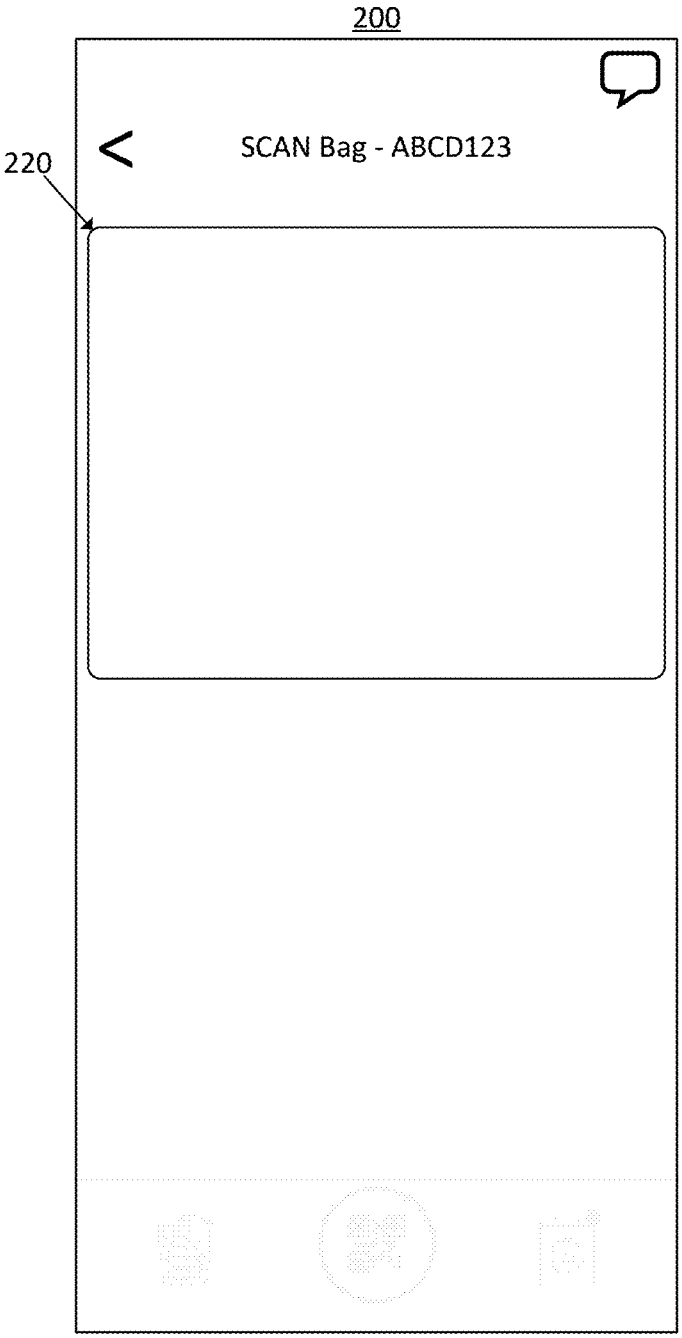
FIG. 2D is a diagram illustrating an exemplary graphical user interface for a washer service in accordance with aspects of the present disclosure.
Figure 2E:
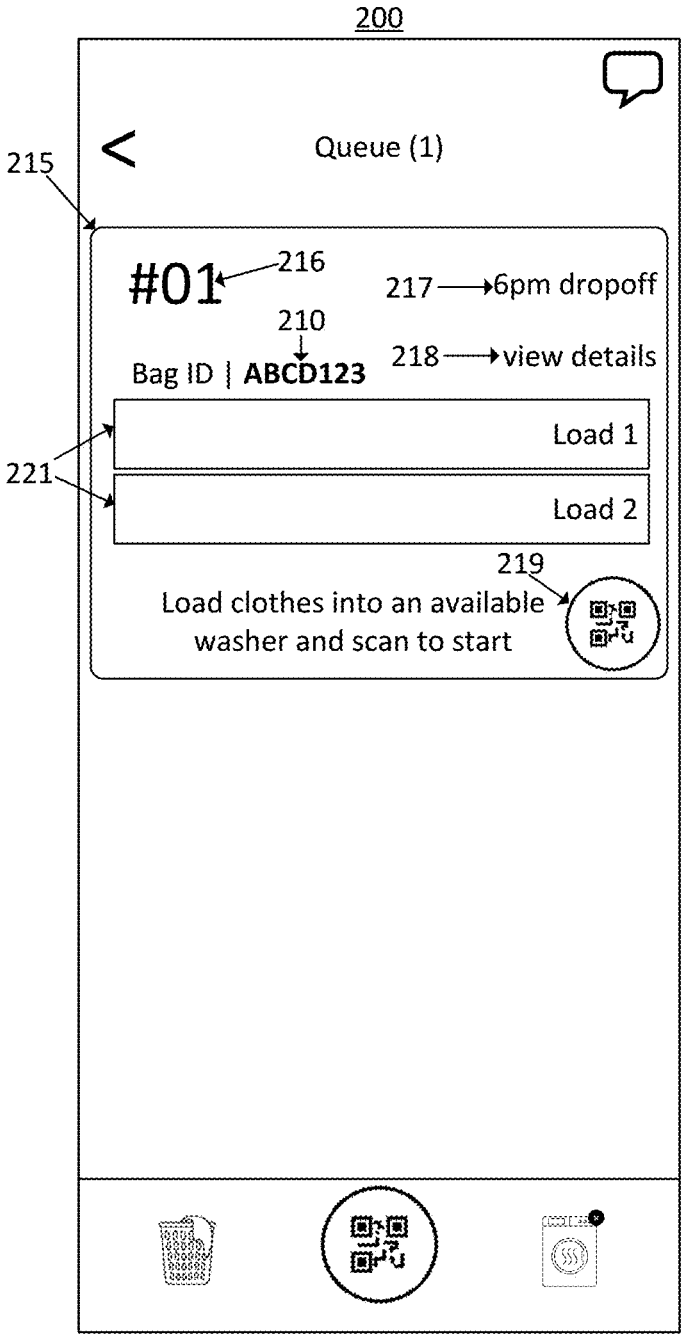
FIG. 2E is a diagram illustrating an exemplary graphical user interface for a washer service in accordance with aspects of the present disclosure.
Figure 2F:
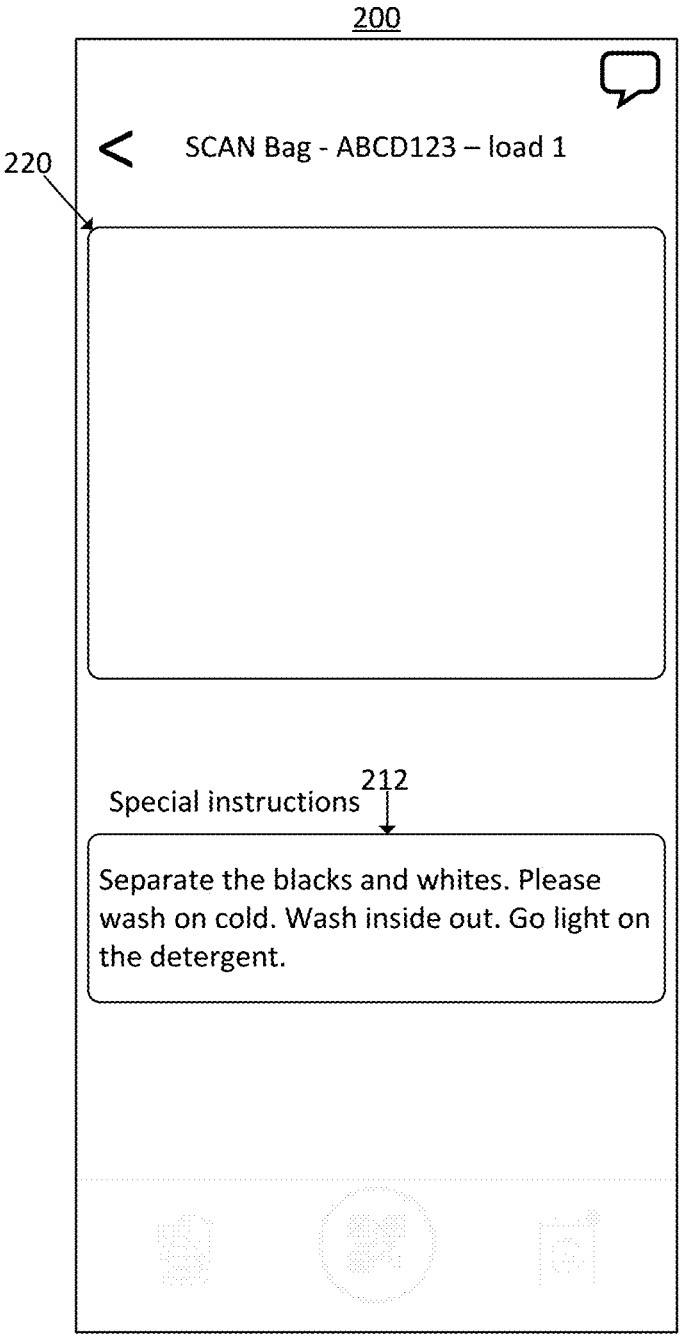
FIG. 2F is a diagram illustrating an exemplary graphical user interface for a washer service in accordance with aspects of the present disclosure.
Figure 2G:
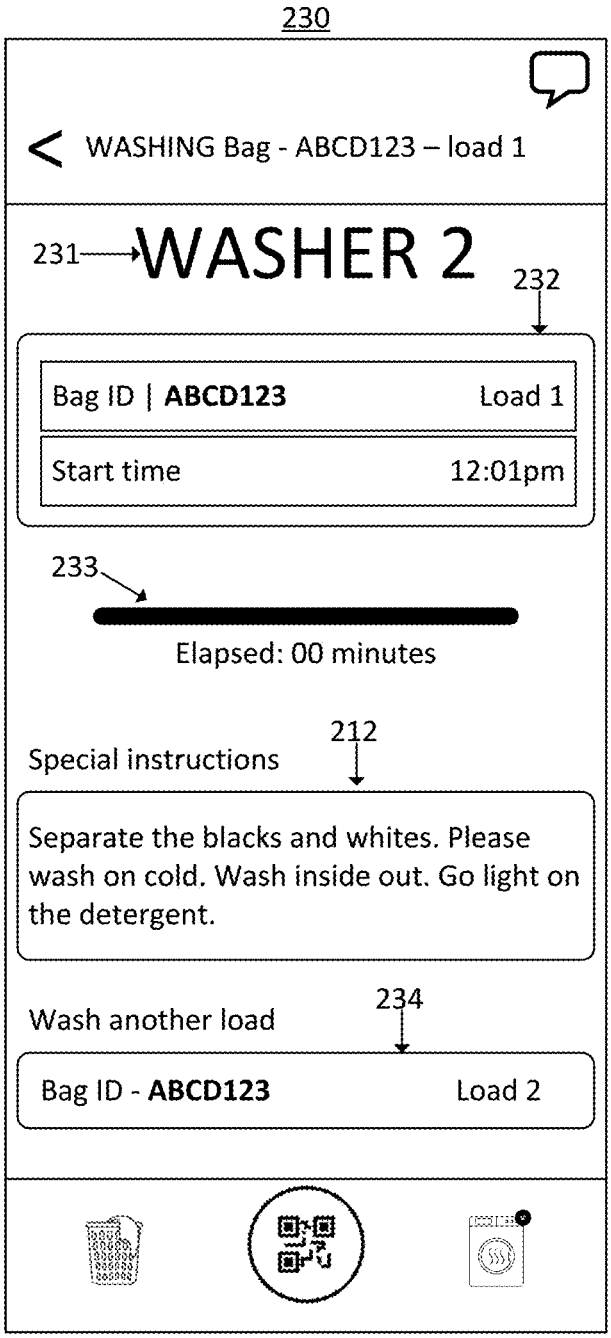
FIG. 2G is a diagram illustrating an exemplary graphical user interface for a washer service in accordance with aspects of the present disclosure.
Figure 2H:
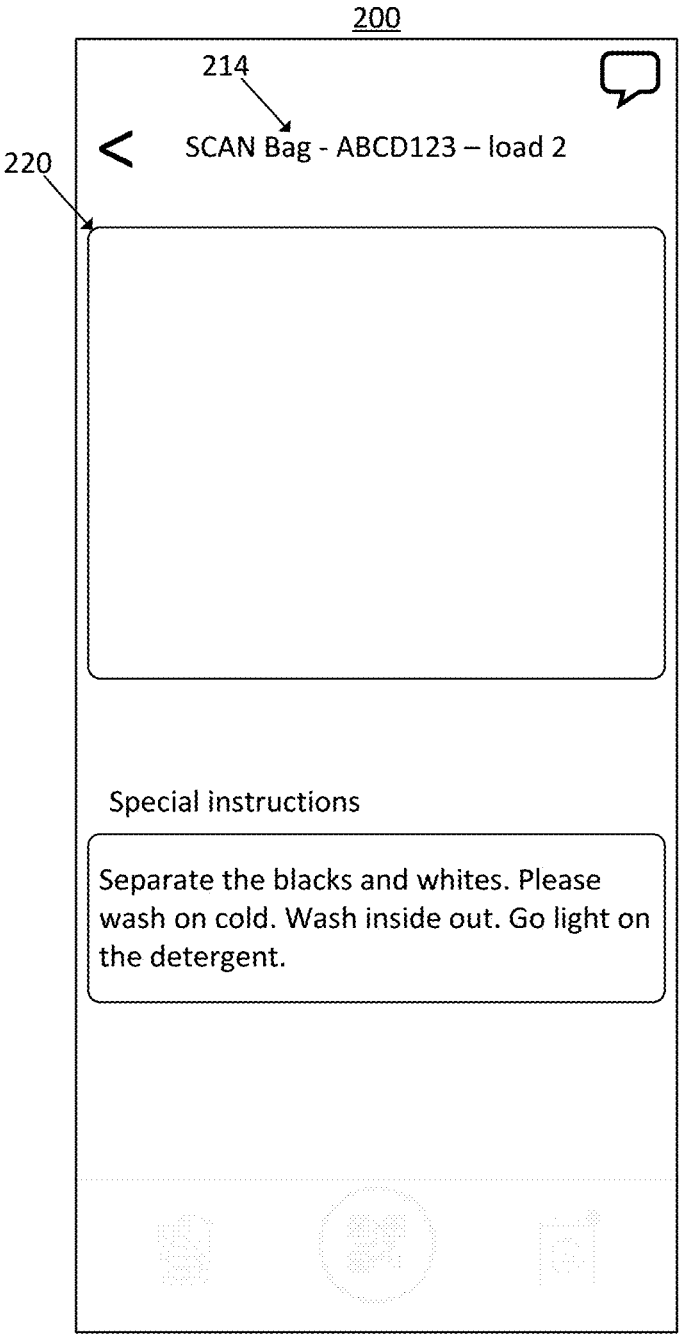
FIG. 2H is a diagram illustrating an exemplary graphical user interface for a washer service in accordance with aspects of the present disclosure.
Figure 2I:
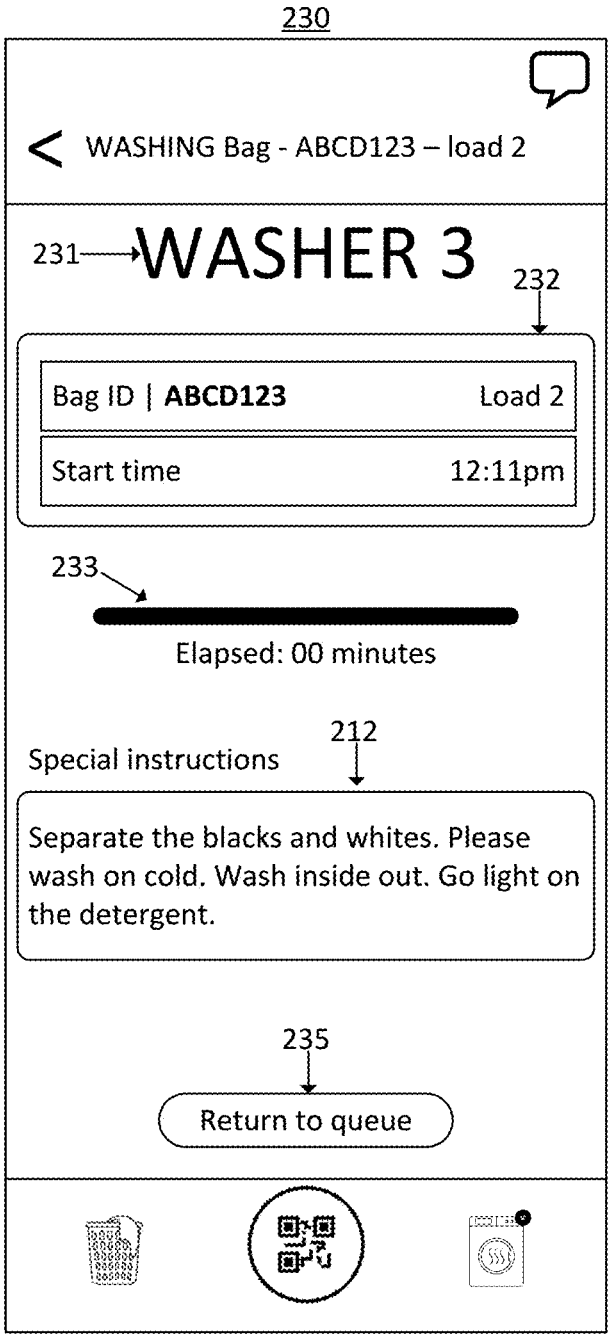
FIG. 2I is a diagram illustrating an exemplary graphical user interface for a washer service in accordance with aspects of the present disclosure.
Figure 2J:
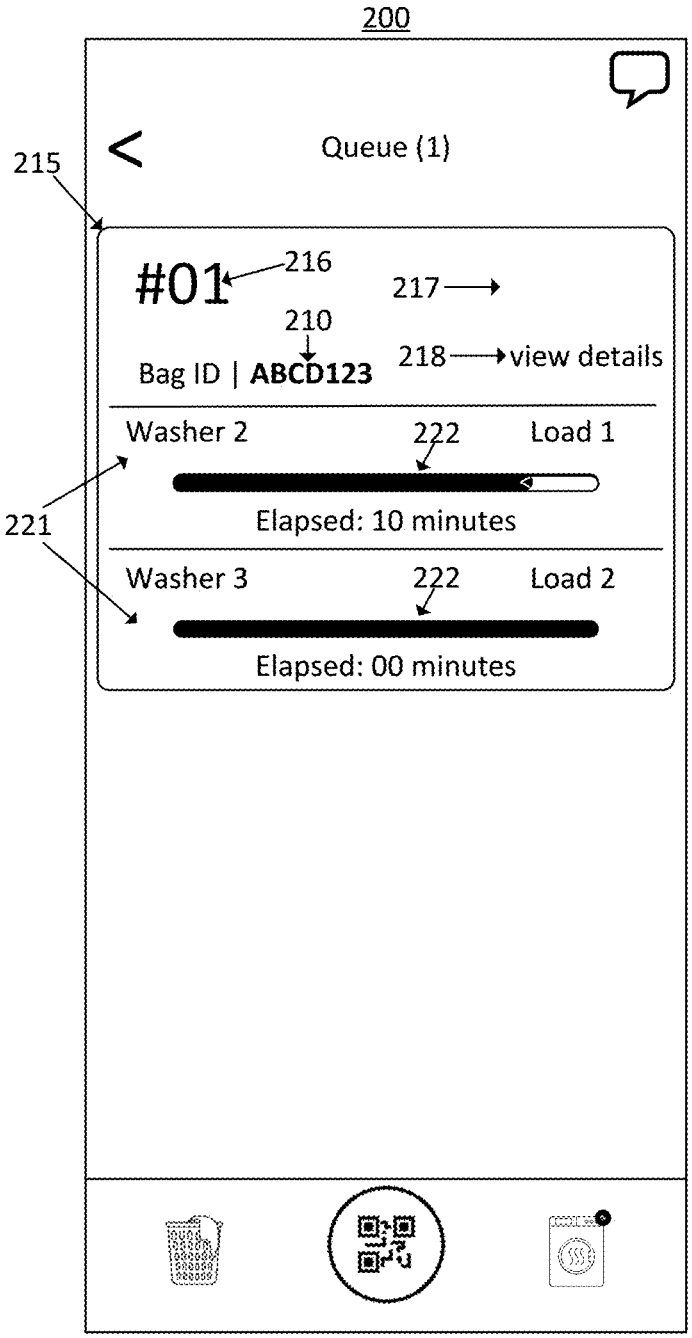
FIG. 2J is a diagram illustrating an exemplary graphical user interface for a washer service in accordance with aspects of the present disclosure.
Figure 2K:
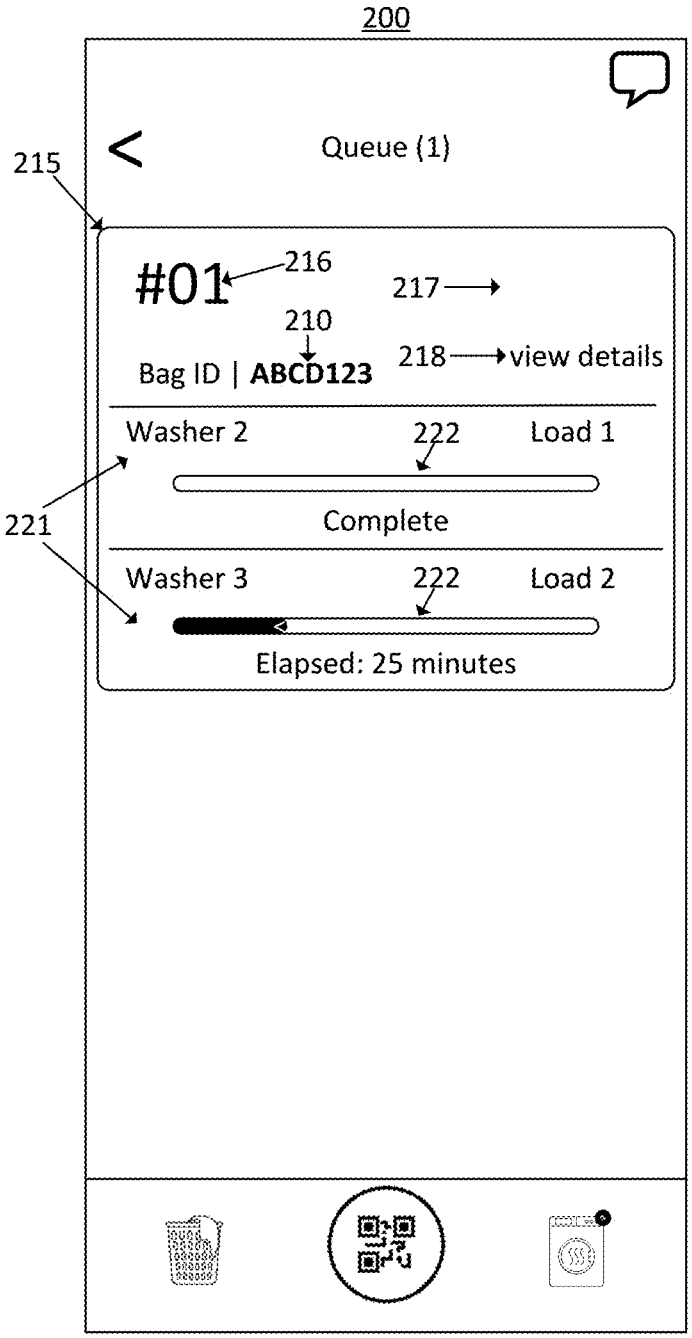
FIG. 2K is a diagram illustrating an exemplary graphical user interface for a washer service in accordance with aspects of the present disclosure.
Figure 2L:
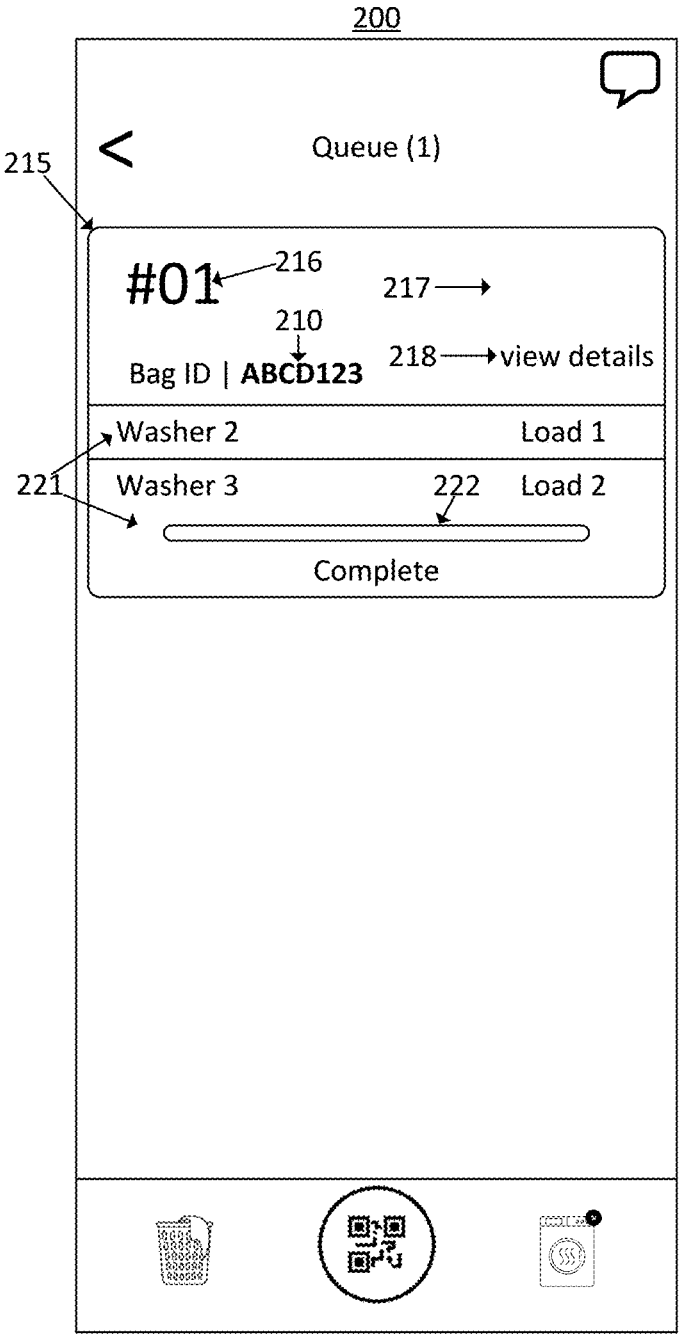
FIG. 2L is a diagram illustrating an exemplary graphical user interface for a washer service in accordance with aspects of the present disclosure.
Figure 2M:
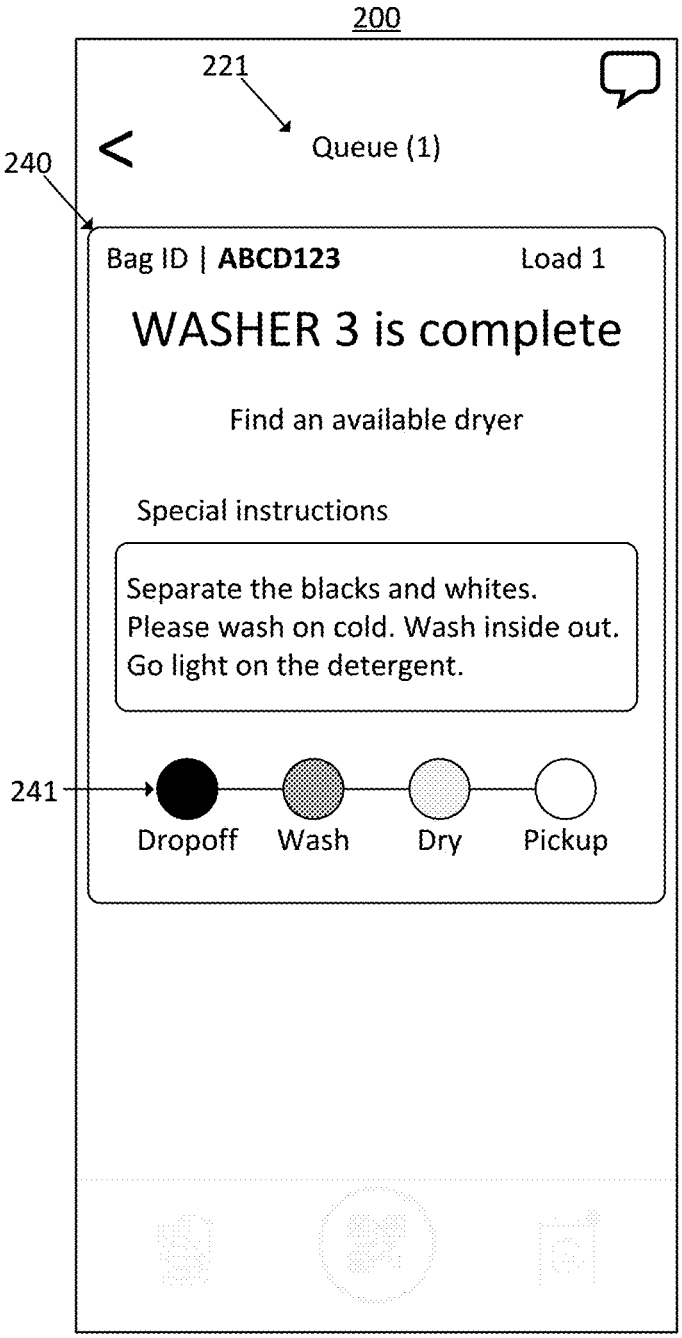
FIG. 2M is a diagram illustrating an exemplary graphical user interface for a washer service in accordance with aspects of the present disclosure.
Figure 2N:
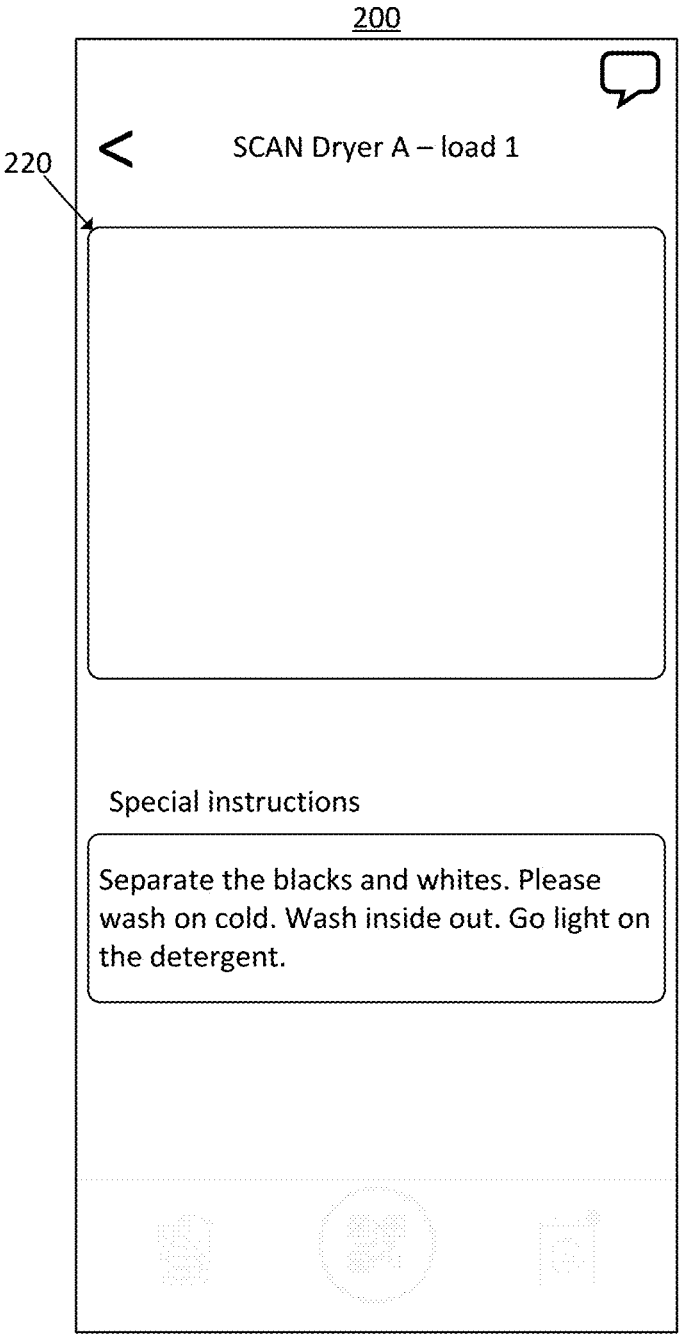
FIG. 2N is a diagram illustrating an exemplary graphical user interface for a washer service in accordance with aspects of the present disclosure.
Figure 2O:
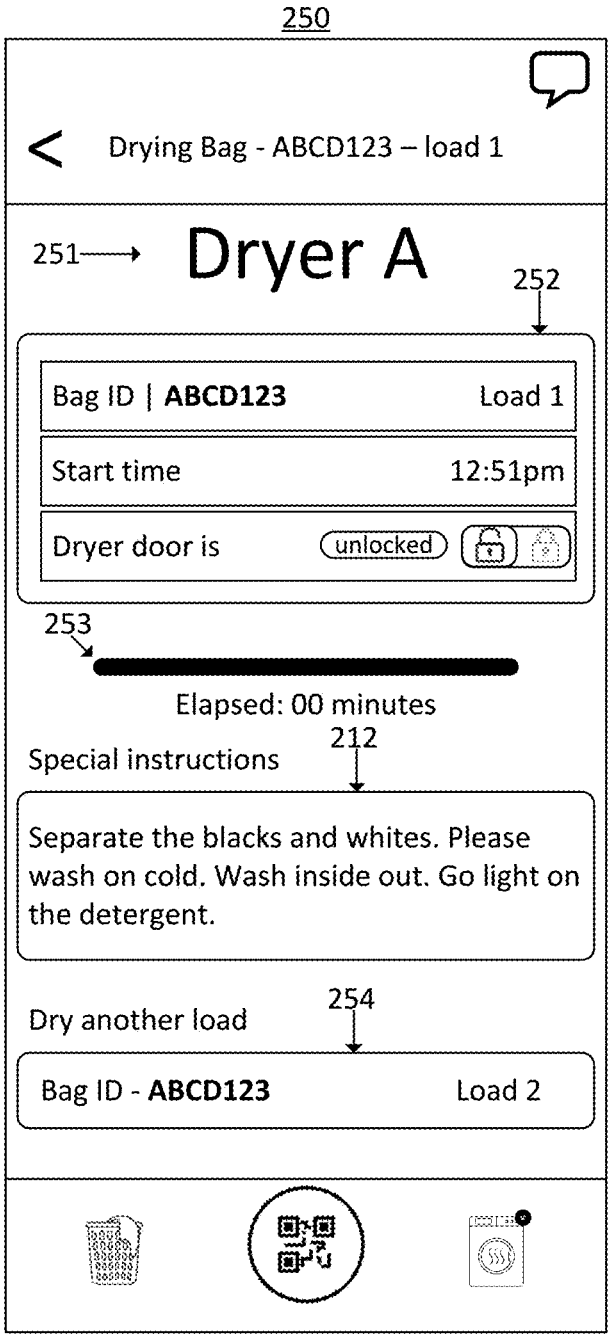
FIG. 2O is a diagram illustrating an exemplary graphical user interface for a washer service in accordance with aspects of the present disclosure.
Figure 2P:
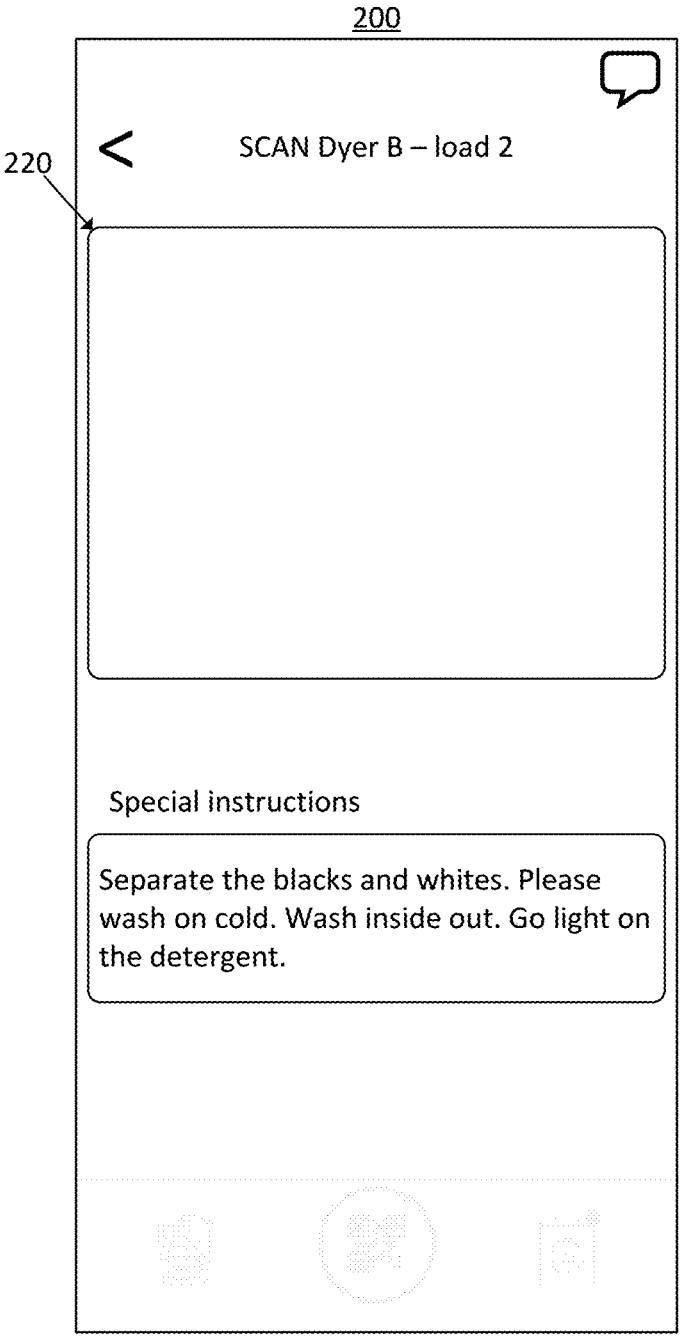
FIG. 2P is a diagram illustrating an exemplary graphical user interface for a washer service in accordance with aspects of the present disclosure.
Figure 2Q:
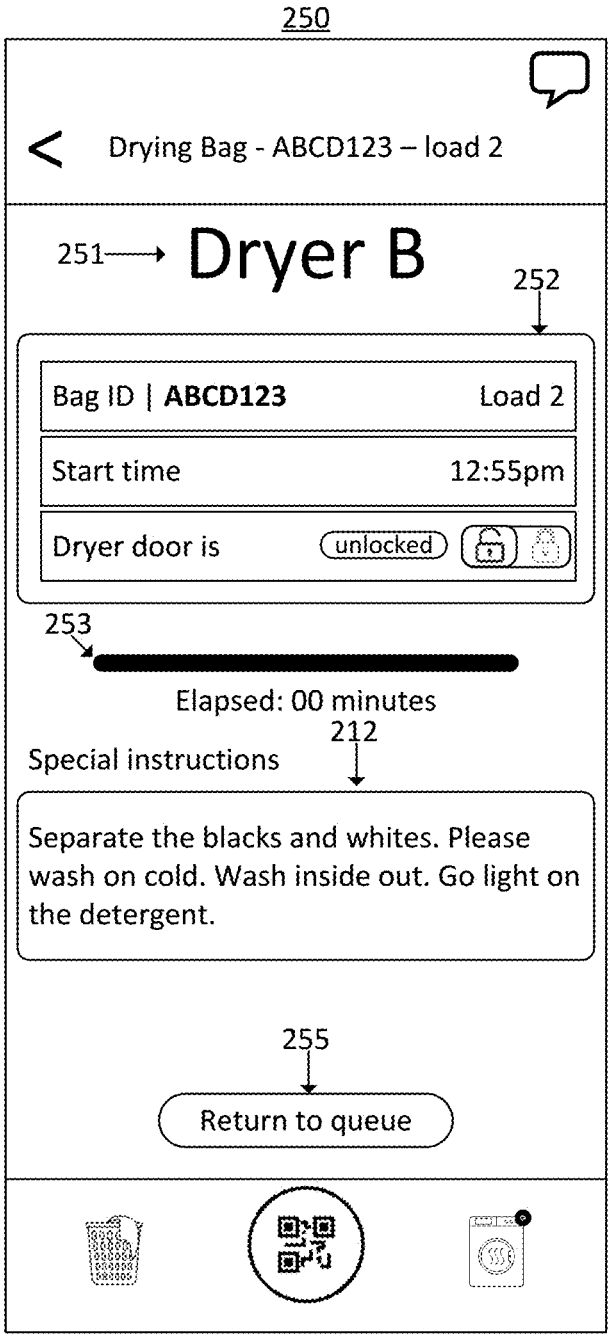
FIG. 2Q is a diagram illustrating an exemplary graphical user interface for a washer service in accordance with aspects of the present disclosure.
Figure 2R:
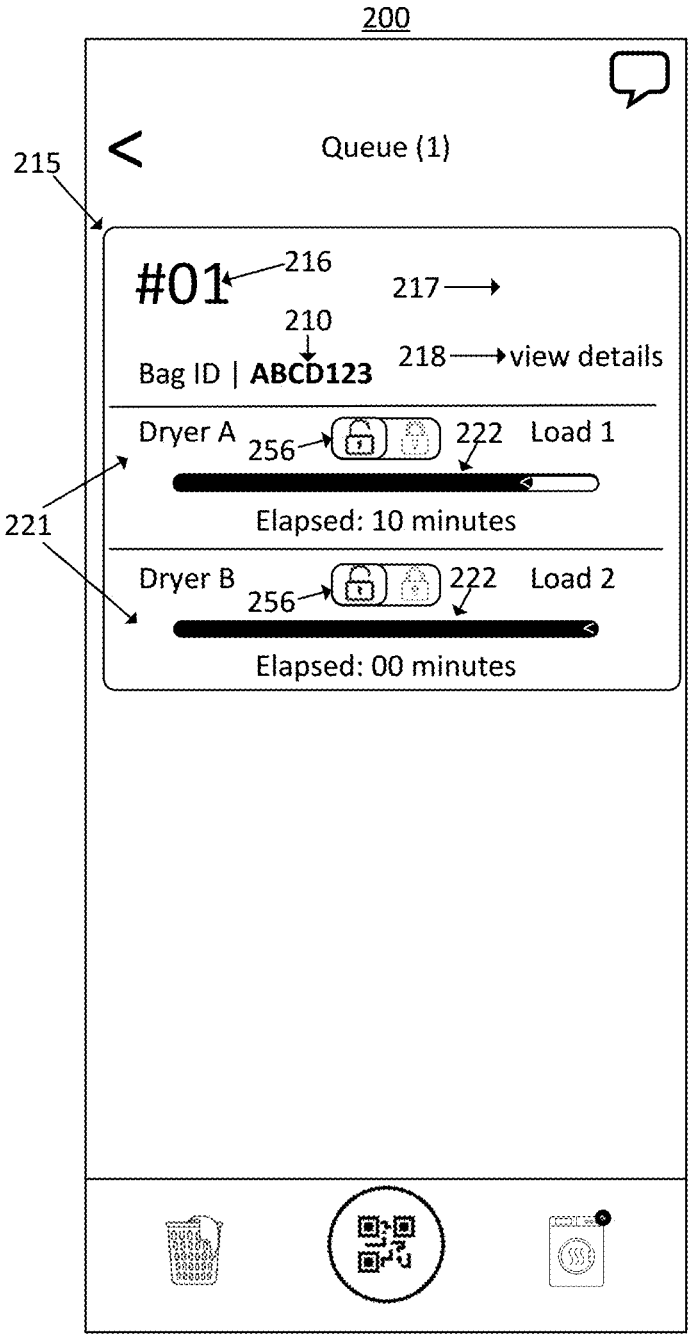
FIG. 2R is a diagram illustrating an exemplary graphical user interface for a washer service in accordance with aspects of the present disclosure.
Figure 2S:
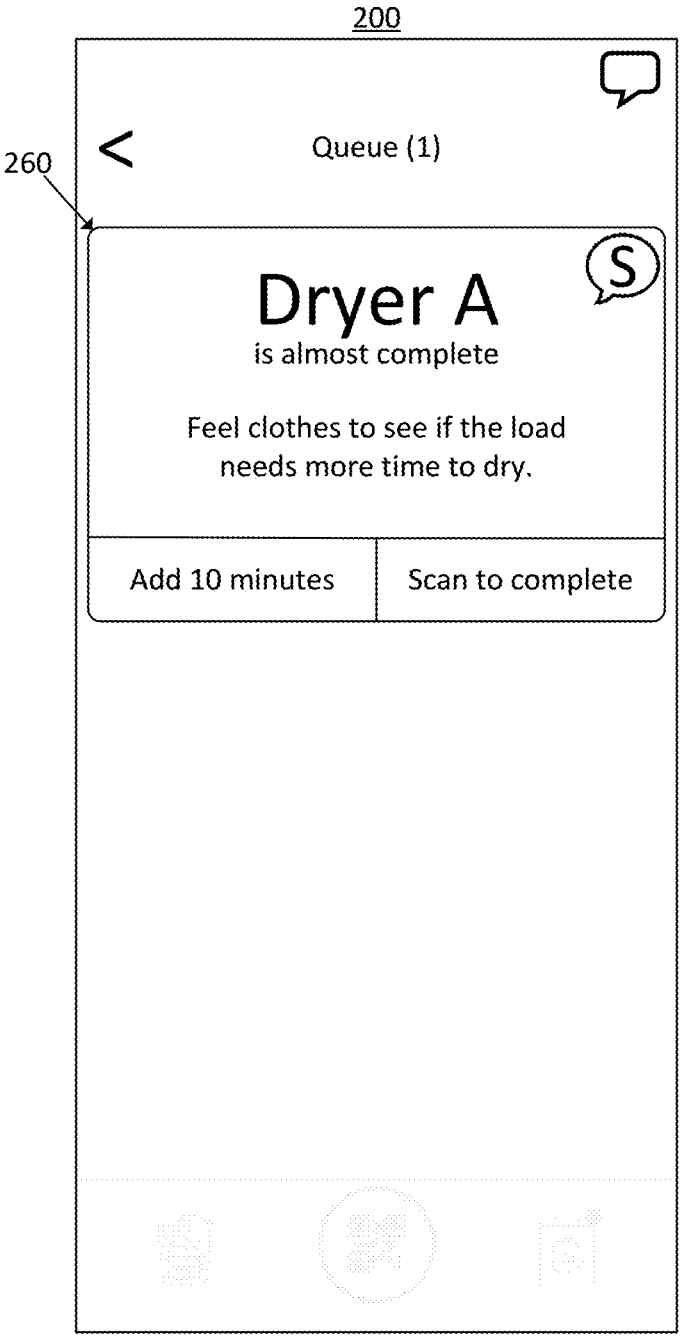
FIG. 2S is a diagram illustrating an exemplary graphical user interface for a washer service in accordance with aspects of the present disclosure.
Figure 2T:
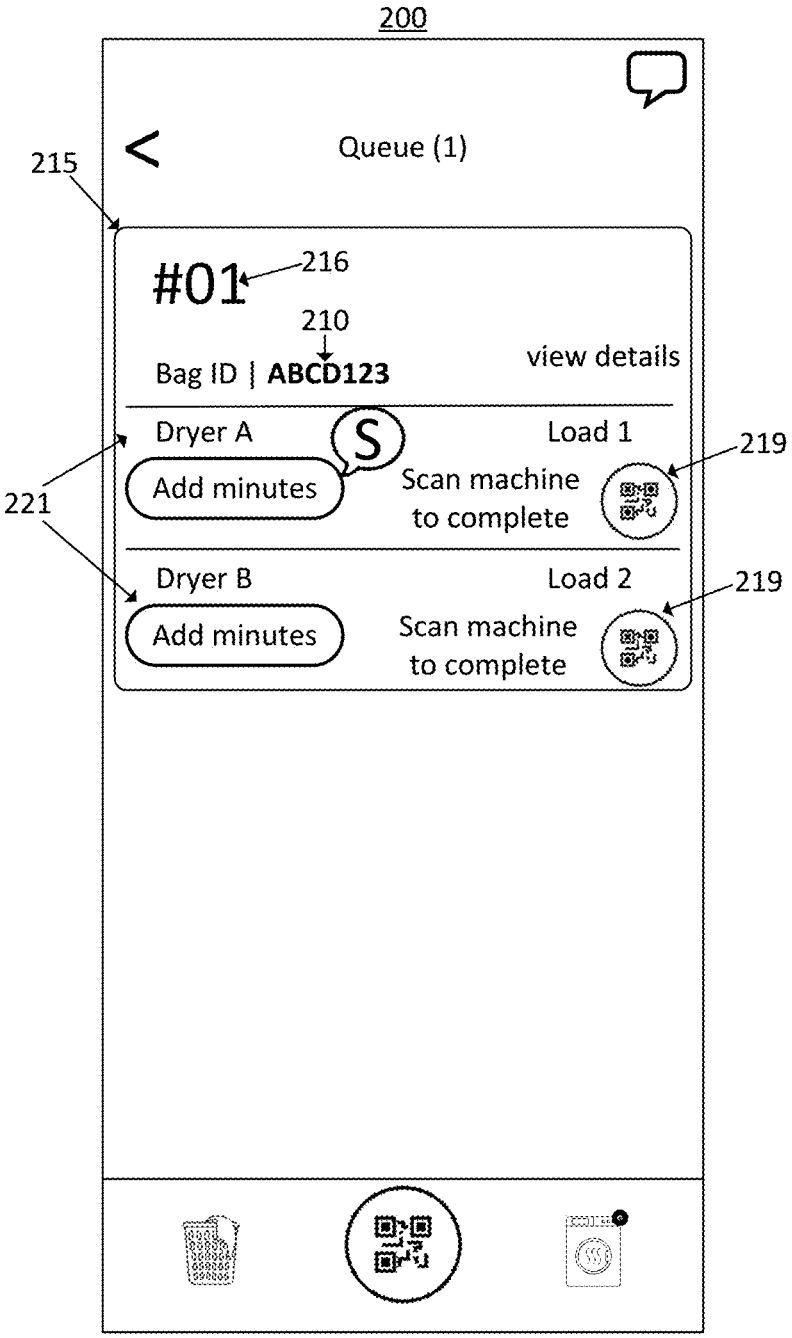
FIG. 2T is a diagram illustrating an exemplary graphical user interface for a washer service in accordance with aspects of the present disclosure.
Figure 2U:
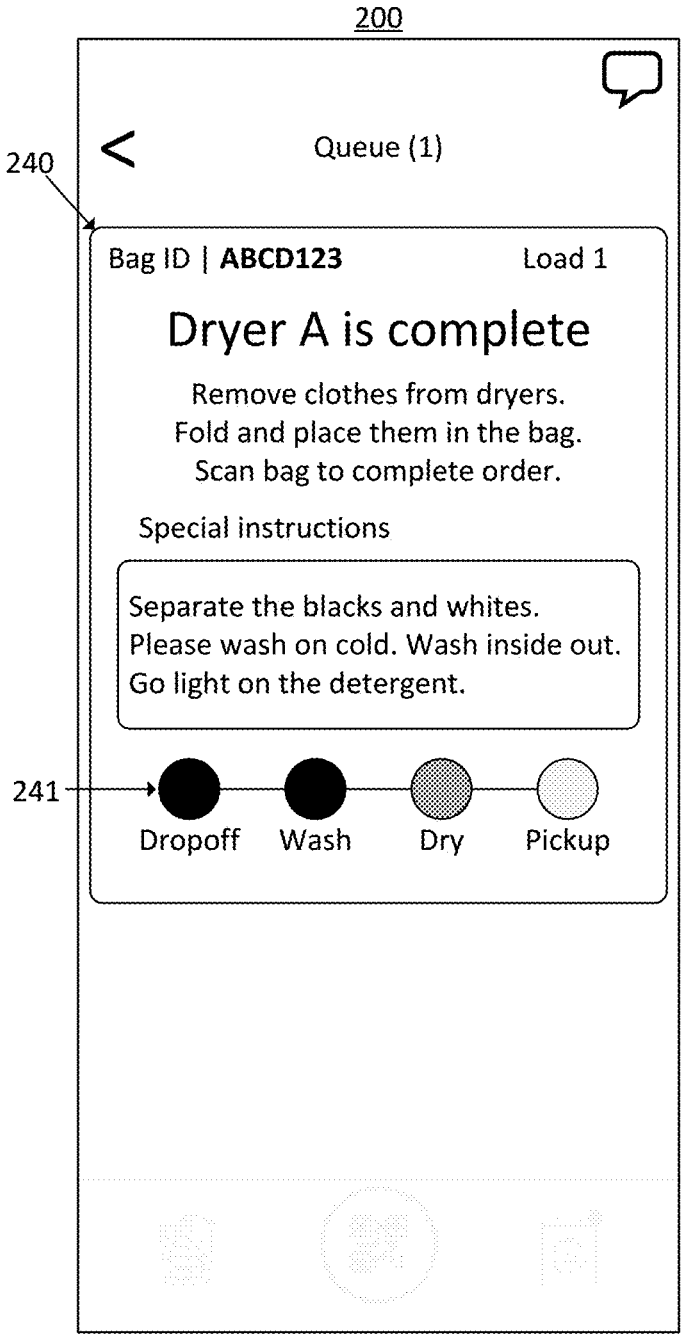
FIG. 2U is a diagram illustrating an exemplary graphical user interface for a washer service in accordance with aspects of the present disclosure.
Figure 2V:
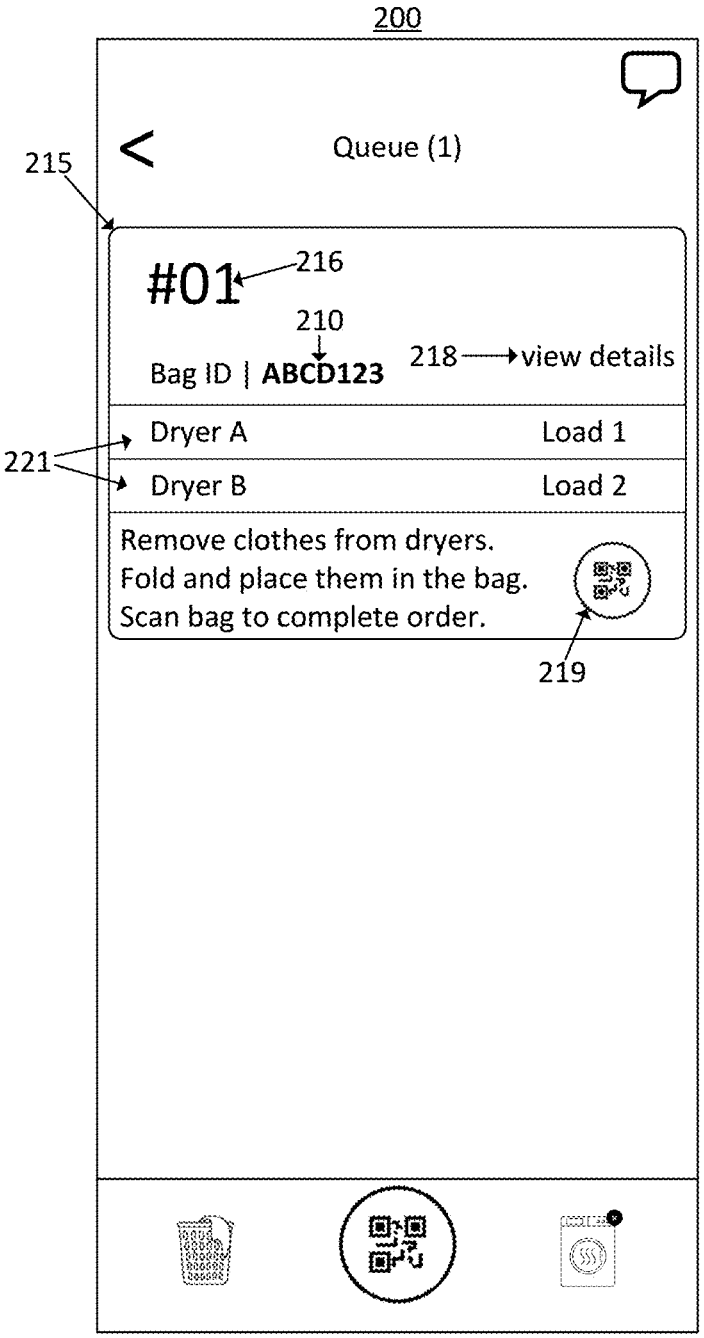
FIG. 2V is a diagram illustrating an exemplary graphical user interface for a washer service in accordance with aspects of the present disclosure.
Figure 2W:
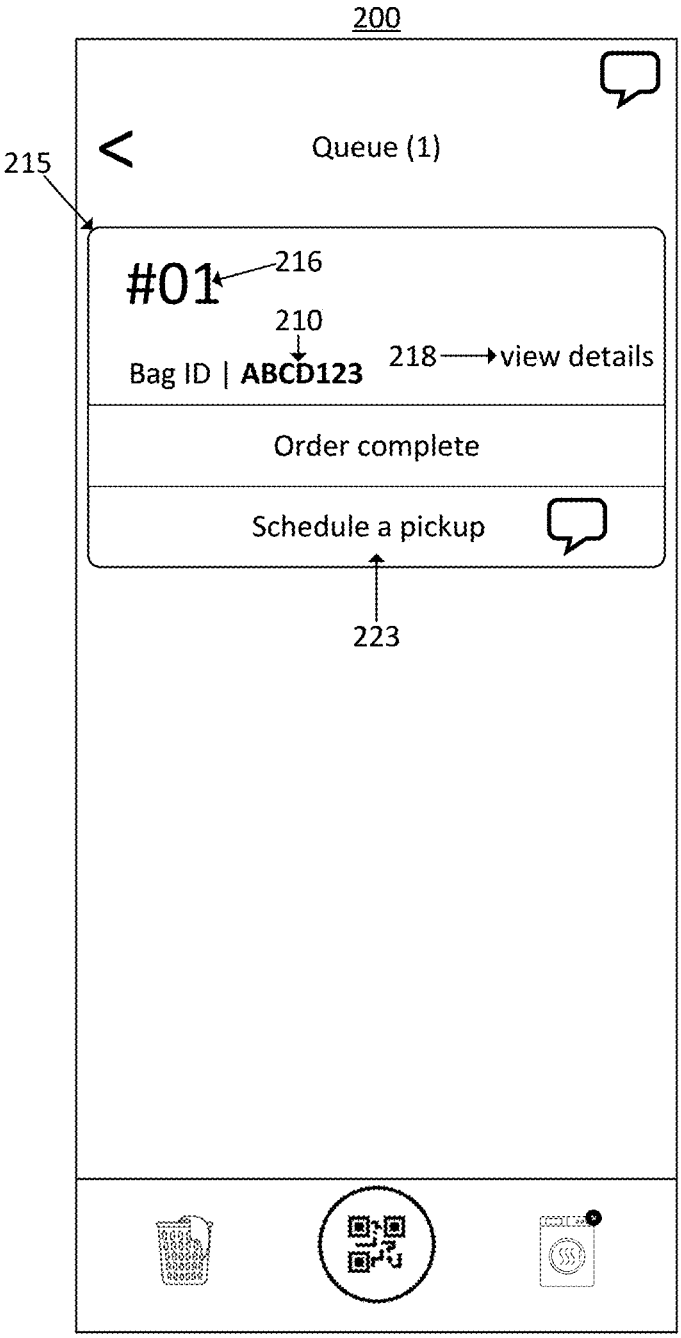
FIG. 2W is a diagram illustrating an exemplary graphical user interface for a washer service in accordance with aspects of the present disclosure.

FIGS. 2A-2W are diagrams illustrating an exemplary graphical user interface 200 used by a washer when processing a laundry service order in accordance with aspects of the present disclosure.

FIG. 2A shows a home or default screen of GUI 200. The mode screen may comprise an online/offline indicator 201, washer profile information 202, past order information 203/204 and a home scan button 205. The past order information may comprise one or more lists of past laundry service orders processed, wherein the list may be separated by date 203 and further separated by order 204.

FIG. 2B shows an order notification 206 being displayed on GUI 200. The notification 206 may include a washer score 207, order value 208, delivery time 209, bag ID 210, load information 211, special instructions 212, an accept button 213 to accept the order and a button to skip or decline the order.

In some embodiments, the washer may be notified of, and offered, a customer laundry service order based on the washer score. The washer score may be calculated based on distance from the customer placing the order, capacity of the laundry facility at the washer's location and drive time. In some embodiments, distance and drive time may be weighted more heavily than capacity. For each order, a washer score for one or more washers may be generated. The order notification may be distributed to one or more washers within a predetermined area or with a washer score above a predetermined threshold.

A laundry service order ("order") may be generated by a customer 101 through a mobile application, web application or other electronic request platform. To generate the order, the customer may be prompted to place clothing in one or more uniquely identifiable bags 102. The customer 101 may then scan a barcode, QR code, RFID tag or other scannable unique identifiers attached to the one or more bags 102. In some embodiments, the customer application may display a list of bags that have been scanned. If the customer 101 wishes to provide special instructions for the washer, they may select one or more of the bags from the list of bags. For each selected bag, the customer may select from a provided list of special instructions or enter their special instructions in a free text input box.

After the washer accepts the order by clicking the accept button 213, the order is added to the washer's queue. The washer's queue is shown in FIG. 2C. The washer's queue may be configured to display a title 214 and one or more bag information boxes 215. Bag information box may further include bag ID 210, a bag number 216, bag drop off time 217, additional details button 218, and a bag scan button 219.

In some embodiments, after the washer accepts the order, a delivery service may be dispatched to retrieve the one or more bags associated with the order. Upon delivery of the bags to the washer, the washer may scan the one or more bags by selecting the bag scan button 219 and capturing the unique identifier attached to each of the bags. As shown in FIG. 2D, the washer may be shown a scanning screen 220, wherein images captured by a camera of the client 105 is shown. The washer may use this screen to guide the capturing of barcodes or QR codes attached to the one or more bags. In some embodiments, the scanning screen may be configured to scan RFID/NFC tags.

Upon scanning the one or more bags, the bag information box 215 in the washer's queue may be updated with one or more loads 221 associated with the bag. This can be seen in FIG. 2E.

The washer may then select a load from the bag information box. Upon selection of a load, the washer may then be provided with a scanning screen associated with the selected load, as can be seen in FIG. 2F. This screen may also display special instructions associated with selected load or bag. The title of the screen may be changed to identify that the scanning to be performed is for the selected load. For example, in FIG. 2F, the title is shown as "SCAN Bag-ABCD123—load 1" to indicate that the scanning screen is associated with the first load. From this screen the washer may scan a barcode, QR code or RFID/NFC tag of a washing machine in which the load will be washed in. In some embodiments, the washing machine may be inoperable until the washer has selected a load and scanned the washing machine.

FIG. 2G shows a washing machine status interface 230. The washing machine status interface 230 may comprise a washing machine name 231, active load information 232, machine progress bar 233 and additional load scanning button 234. Active load information 232 may identify the bag ID, load number and the start time of the machine. Progress bar 233 may visually indicate the remaining time of the machine operation.

FIGS. 2H and 2I are similar to that of FIGS. 2F and 2G. However, FIGS. 2H and 2I show the process for selecting and scanning a second washing machine for load 2. FIG. 2I may also provide a navigation button to return to the queue 235.

FIGS. 2J-2L show the washer's queue after both loads have been placed in washing machines and the wash cycle started. A washing machine progress bar 222 may be shown for each of the loads.

FIG. 2M shows a load status window 240. The load status window may display information relating to the load, such as the washing machine name, the status of the load in the washing machine, next step instructions, special instructions and a load progress bar 241. Load progress bar may show distinct stages that the load has progressed through, such as drop off, wash, dry and pickup. After a stage has been completed, the circle associated with said stage may be filled in or otherwise modified to indicate the completion. In FIG. 2M, the drop off stage is filled in with dark black to show that the stage was previously completed. The wash stage may be filled in with a different color or such as dark grey to show that the stage has just been completed. The dry stage may be filled in with a light grey to show that the dry stage is the next stage to be started. An empty or white circle may be used to indicate a stage that is to be completed in the future, such as pickup in FIG. 2M.

FIG. 2N shows a scanning screen 220 for associating load 1 with Dryer A. In some embodiments, the scanning screen may be displayed to the washer in response to the washer selecting the load from the washer's queue after the load has completed a washing cycle. In other embodiments, the washer may need to scan the load out of the washing machine before being allowed to scan the load into the dryer. In some embodiments, after the washer scans the washing machine, a dryer may be assigned to the load automatically, and the washer may then transfer the load from the washing machine to the assigned dryer. In some embodiments, the dryer may only be allowed to start a drying cycle after the washer has scanned the dryer.

FIG. 2O shows a dryer status interface 250. The dryer status interface 250 may comprise a dryer name 251, active load information 252, machine progress bar 253 and additional load scanning button 254. Active load information 252 may identify the bag ID, load number and the start time of the machine. Progress bar 253 may visually indicate the remaining time of the machine operation. Active load information 253 may further comprise a lock status of the dryer door as well as functionality that allows the washer to lock and unlock the dryer.

The process described with relation to FIGS. 2M-2O may also be used for load 2 or any other load. FIG. 2P shows the scanning screen 220 for associating load 2 with Dryer B. FIG. 2Q shows the dryer status interface 250 associated with Dryer B.

FIG. 2R show the washer's queue after both loads have been placed in dryers and the dry cycle started. A dryer progress bar 222 may be shown for each of the loads. A dryer lock control 256 may also be displayed for each of the loads. The dryer lock control 256 may display the current status of the lock as well as allow the washer to engage/disengage the lock from the queue.

FIG. 2S shows a dryer alert 260 that may be displayed to the washer. The dryer alert 260 may include an indication of time until the process is completed, an option to increase the amount of time that the dryer is to run and/or an option to complete the process. If the clothes are sufficiently dry, the washer may choose "scan to complete."

FIG. 2T shows the washer's queue and is similar to that of FIG. 2L. The washer may choose a load from the queue to begin the scanning out process. In some embodiments, when the washer selects a load from the queue, they may be prompted to scan the dryer associated with the load before removing the load.

FIG. 2U shows a load status window 240 for the dryer associated with the selected load. FIG. 2U is similar to that of FIG. 2M.

FIG. 2V shows the washer's queue after the loads have been scanned out of their associated dryers. After removal of the loads from the dryers, the washer may fold the removed loads. The folded loads may then be scanned into the bag in which they were originally received. Scanning in the load to the bag may comprise placing the folded load into the original bag and scanning the unique identifier attached to the bag.

FIG. 2W show the washers queue after completion of the order. The washer may then schedule or request a pickup of the bags associated with the completed order from the delivery service. In some embodiments, the washer may perform a final scan of the bags at the time of transfer from the washer to the delivery service.

Figure 3:
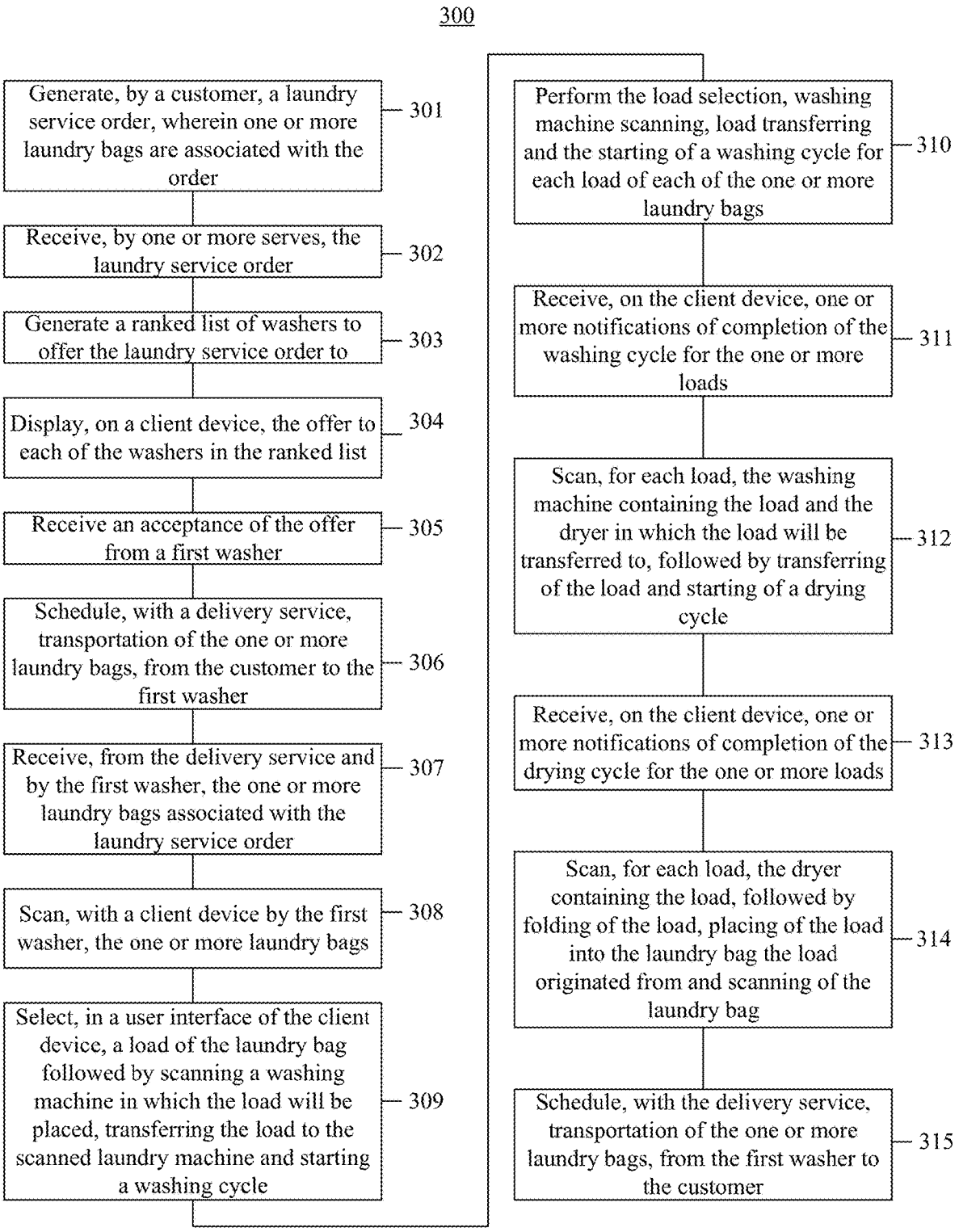
FIG. 3 is a flow chart illustrating an exemplary method that may be performed in accordance with some embodiments.

FIG. 3 is a flow chart illustrating an exemplary method for scheduling, tracking and monitoring a laundering process 300 that may be performed in accordance with some embodiments.

At step 301, the system may be configured to generate, by a customer, a laundry service order, wherein one or more laundry bags are associated with the order.

At step 302, the system may be configured to receive, by one or more serves, the laundry service order.

At step 303, the system may be configured to generate a ranked list of washers to offer the laundry service order to.

At step 304, the system may be configured to display, on a client device, the offer to each of the washers in the ranked list.

At step 305, the system may be configured to receive an acceptance of the offer from a first washer.

At step 306, the system may be configured to schedule, with a delivery service, transportation of the one or more laundry bags, from the customer to the first washer.

At step 307, the system may be configured to receive, from the delivery service and by the first washer, the one or more laundry bags associated with the laundry service order.

At step 308, the system may be configured to scan, with a client device by the first washer, the one or more laundry bags.

At step 309, the system may be configured to select, in a user interface of the client device, a load of the laundry bag followed by scanning a washing machine in which the load will be placed, transferring the load to the scanned laundry machine and starting a washing cycle.

At step 310, the system may be configured to performing the load selection, washing machine scanning, load transferring and the starting of a washing cycle for each load of each of the one or more laundry bags.

At step 311, the system may be configured to receive, on the client device, one or more notifications of completion of the washing cycle for the one or more loads.

At step 312, the system may be configured to scan, for each load, the washing machine containing the load and the dryer in which the load will be transferred to, followed by transferring of the load and starting of a drying cycle.

At step 313, the system may be configured to receive, on the client device, one or more notifications of completion of the drying cycle for the one or more loads.

At step 314, the system may be configured to scan, for each load, the dryer containing the load, followed by folding of the load, placing of the load into the laundry bag the load originated from and scanning of the laundry bag.

At step 315, the system may be configured to schedule, with the delivery service, transportation of the one or more laundry bags, from the first washer to the customer.

Figure 4A:
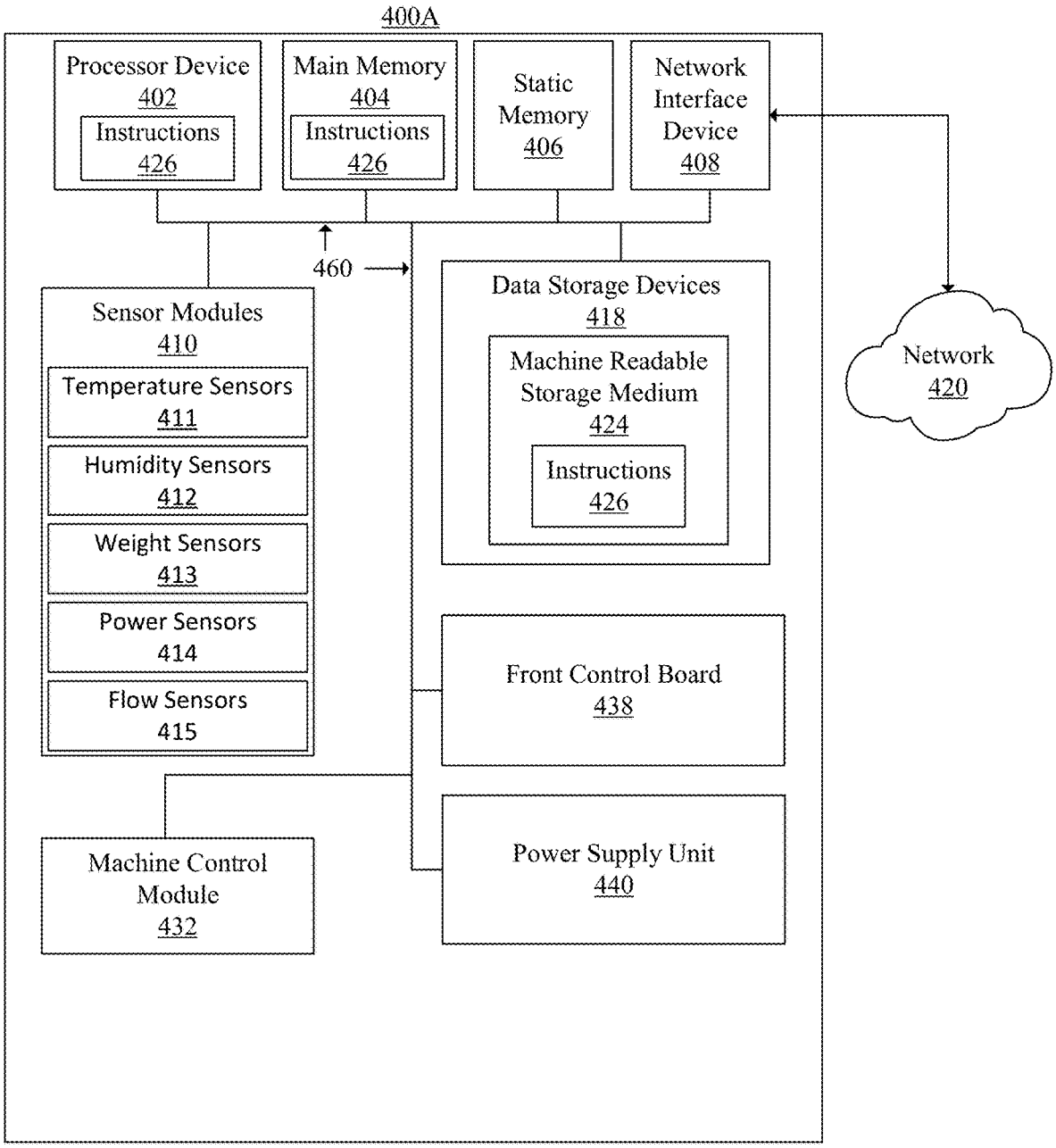
FIG. 4A is a diagram illustrating an exemplary computer/control system that may perform processing in some embodiments and in accordance with aspects of the present disclosure.

FIG. 4A illustrates an example machine of a computer system within which a set of instructions, for causing the machine to perform any one or more of the methodologies discussed herein, may be executed. In alternative implementations, the machine may be connected (e.g., networked) to other machines in a LAN, an intranet, an extranet, an ad-hoc network, a mesh network, and/or the Internet. The machine may operate in the capacity of a server or a client machine in a client-server network environment, as a peer machine in a peer-to-peer (or distributed) network environment, or as a server or a client machine in a cloud computing infrastructure or environment.

The machine may be a personal computer (PC), a tablet PC, a set-top box (STB), a Personal Digital Assistant (PDA), a cellular telephone, a web appliance, a server, a network router, a switch or bridge, or any machine capable of executing a set of instructions (sequential or otherwise) that specify actions to be taken by that machine. Further, while a single machine is illustrated, the term "machine" shall also be taken to include any collection of machines that individually or jointly execute a set (or multiple sets) of instructions to perform any one or more of the methodologies discussed herein.

The example computer system 400A includes a processing device 402, a main memory 404 (e.g., read-only memory (ROM), flash memory, dynamic random access memory (DRAM) such as synchronous DRAM (SDRAM) or Rambus DRAM (RDRAM), etc.), a static memory 406 (e.g., flash memory, static random access memory (SRAM), etc.), and a data storage device 418, which communicate with each other via a bus 460.

Processing device 402 represents one or more general-purpose processing devices such as a microprocessor, a central processing unit, or the like. More particularly, the processing device may be complex instruction set computing (CISC) microprocessor, reduced instruction set computing (RISC) microprocessor, very long instruction word (VLIW) microprocessor, or processor implementing other instruction sets, or processors implementing a combination of instruction sets. Processing device 402 may also be one or more special-purpose processing devices such as an application specific integrated circuit (ASIC), a field programmable gate array (FPGA), a digital signal processor (DSP), network processor, or the like. The processing device 402 is configured to execute instructions 426 for performing the operations and steps discussed herein.

The computer system 400A may further include a network interface device 408 to communicate over the network 420. The computer system 400A also may include sensor modules 410. Sensor modules 410 may comprise temperature sensors 411, humidity sensors, 412, weight sensors 413, power sensors 414 and flow sensors 415. Sensor modules 410 may be the same or similar to that of sensor module 175A/175B of FIGS. 1D and 1E.

The data storage device 418 may include a machine-readable storage medium 424 (also known as a computer-readable medium) on which is stored one or more sets of instructions or software 426 embodying any one or more of the methodologies or functions described herein. The instructions 426 may also reside, completely or at least partially, within the main memory 404 and/or within the processing device 402 during execution thereof by the computer system 400A, the main memory 404 and the processing device 402 also constituting machine-readable storage media.

The computer system 400A may further include a machine control module 432. The Machine control module 432 may be the same or similar to machine controller 170A/170B of FIGS. 1D and 1E.

The computer system 400A may further include front control board 438 and power supply unit 440.

The front control board 438 may be configured to control the operation of the laundry machine. In some embodiments, the front control board 428 may be an OEM control unit. Machine control module 432 may be configured to interface with the front control board 438, allowing for control of all some or all aspects of the laundry machine's operation. In some embodiments, there may be one or more front control boards 438 in the laundry machine. The one or more front control boards 438 may be built-in controllers for the machine. In some embodiments, the machine controller module 432 may be a board that is retrofitted to the washing machine to enable control, management and monitoring of the machine.

Power supply unit 440 may be configured to receive wall power input from a power source. The power source may be a power outlet, battery, mains power or any other electrical power source. In some embodiments, power supply unit may be configured to convert, condition and/or transform the power input, and generate a plurality of power outputs. In some embodiments, the power supply unit 440 may be configured to provide power to control circuitry of the laundry machine as well as electromechanical units within the machine, such as motors, heating elements, actuators, and other units that facilitate washing/drying operations.

In one implementation, the instructions 426 include instructions to implement functionality corresponding to the components of a device to perform the disclosure herein.

While the machine-readable storage medium 424 is shown in an example implementation to be a single medium, the term "machine-readable storage medium" should be taken to include a single medium or multiple media (e.g., a centralized or distributed database, and/or associated caches and servers) that store the one or more sets of instructions. The term "machine-readable storage medium" shall also be taken to include any medium that is capable of storing or encoding a set of instructions for execution by the machine and that cause the machine to perform any one or more of the methodologies of the present disclosure. The term "machine-readable storage medium" shall accordingly be taken to include, but not be limited to, solid-state memories, optical media and magnetic media.

Figure 4B:
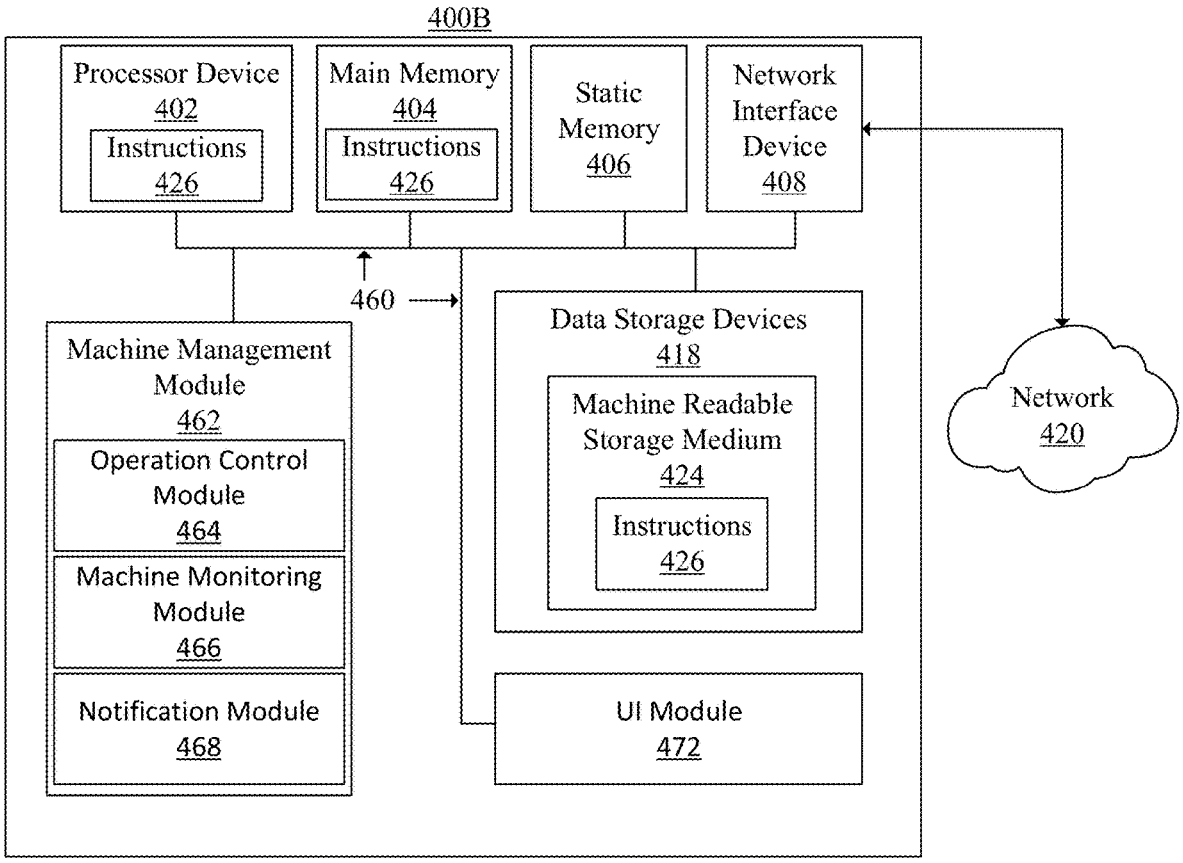
FIG. 4B is a diagram illustrating an exemplary computer/control system that may perform processing in some embodiments and in accordance with aspects of the present disclosure.
Figure 4C:
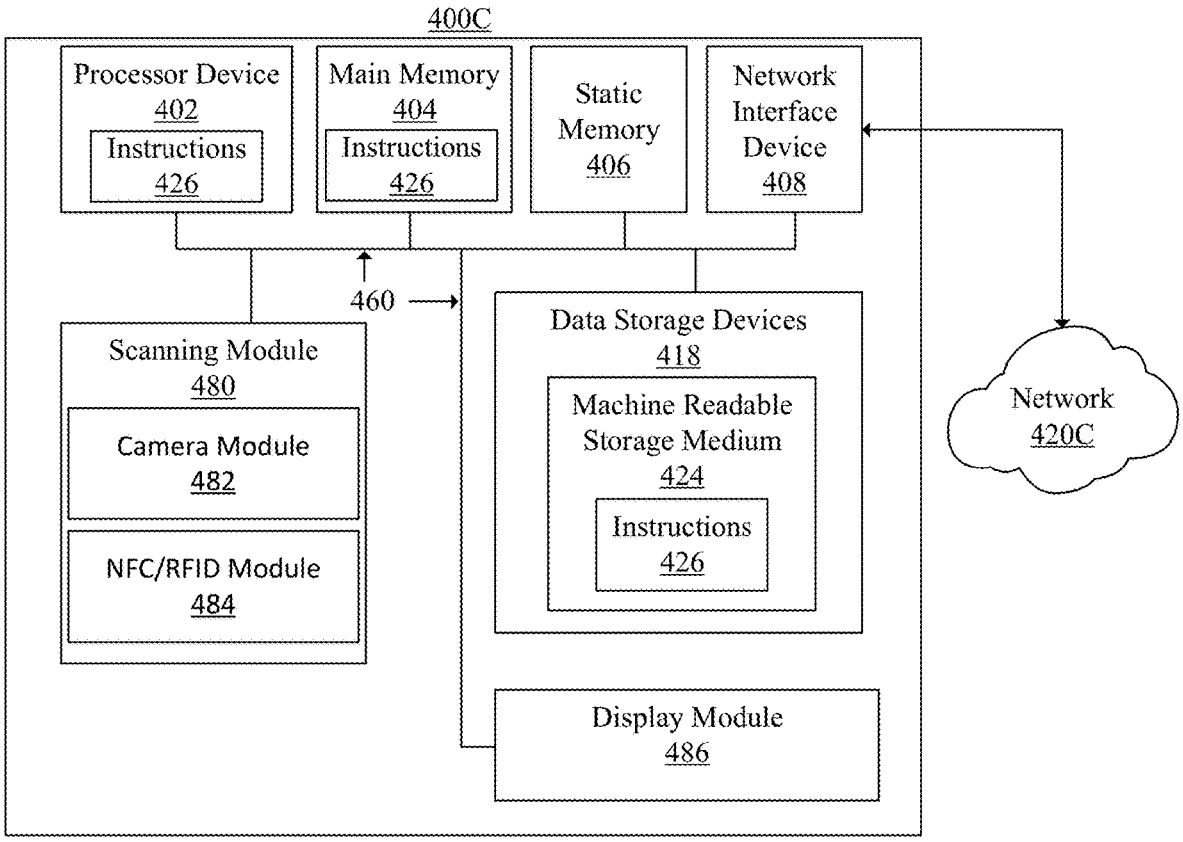
FIG. 4C is a diagram illustrating an exemplary computer/control system that may perform processing in some embodiments and in accordance with aspects of the present disclosure.

Regarding FIGS. 4B-4C, processing device 402, a main memory 404, static memory 408, network interface device 408, data storage devices 418, machine readable storage medium 424, instructions 426, network 420 and bus 460 may be the same or similar to that described in FIG. 4A.

The computer system 400B of FIG. 4B may further include a machine management module 462 and a UI module 472.

Machine management module 462 may further comprise operation control module 464, machine monitoring module 466 and notification module 468. Machine management module 462, operation control module 464, machine monitoring module 466 and notification module 468 may be the same or similar to machine management module 146, operation control module 147, machine monitoring module 148 and notification module 149 of FIG. 1B.

UI module 472 may be the same or similar to that of UI module 143 of FIG. 1B.

The computer system 400C of FIG. 4C corresponds to client 105 of FIG. 1C. Scanning module 480, camera module 482, NFC/RFID module 484 and display module 486 may be the same or similar to that of scanning module 165, camera module 166, NFC/RFID module 167 and display module 164 of FIG. 1C.

Some portions of the preceding detailed descriptions have been presented in terms of algorithms and symbolic representations of operations on data bits within a computer memory. These algorithmic descriptions and representations are the ways used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities. Usually, though not necessarily, these quantities take the form of electrical or magnetic signals capable of being stored, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "identifying" or "determining" or "executing" or "performing" or "collecting" or "creating" or "sending" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage devices.

The present disclosure also relates to an apparatus for performing the operations herein. This apparatus may be specially constructed for the intended purposes, or it may comprise a general purpose computer selectively activated or reconfigured by a computer program stored in the computer. Such a computer program may be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, each coupled to a computer system bus.

Various general purpose systems may be used with programs in accordance with the teachings herein, or it may prove convenient to construct a more specialized apparatus to perform the method. The structure for a variety of these systems will appear as set forth in the description above. In addition, the present disclosure is not described with reference to any particular programming language. It will be appreciated that a variety of programming languages may be used to implement the teachings of the disclosure as described herein.

The present disclosure may be provided as a computer program product, or software, that may include a machine-readable medium having stored thereon instructions, which may be used to program a computer system (or other electronic devices) to perform a process according to the present disclosure. A machine-readable medium includes any mechanism for storing information in a form readable by a machine (e.g., a computer). For example, a machine-readable (e.g., computer-readable) medium includes a machine (e.g., a computer) readable storage medium such as a read only memory ("ROM"), random access memory ("RAM"), magnetic disk storage media, optical storage media, flash memory devices, etc.

In the foregoing disclosure, implementations of the disclosure have been described with reference to specific example implementations thereof. It will be evident that various modifications may be made thereto without departing from the broader spirit and scope of implementations of the disclosure as set forth in the following claims. The disclosure and drawings are, accordingly, to be regarded in an illustrative sense rather than a restrictive sense.

What is claimed is:

1. A system to manage a laundry service platform, the system comprising:

a mobile application, operating on multiple client devices, wherein the mobile application comprises a user interface;

one or more servers configured to perform the operations of:

receive a laundry service order associated with one or more laundry bags, the service order being received from a client device from a first user;

determine, by the one or more servers, a washer score for multiple washer users;

generate a ranked list of the multiple washer users;

generate an order offer notification for each of the washer users in the ranked list of washers;

transmit to the multiple client devices of the washer users in the ranked list the order offer notification;

receive, from one of the multiple client devices, an order acceptance notification, from a first washer user; and generate a first delivery service request to the first washer user.

2. The system of claim 1, wherein each of the one or more laundry bags holds one or more loads of laundry and wherein each of the one or more laundry bags comprises a unique identifier.

3. The system of claim 1, wherein the washer score is determined based on a distance between the first user and a particular washer user and a delivery time corresponding to transporting the one or more laundry bags associated with the laundry service order from the first user to the particular washer user.

4. The system of claim 1, wherein the generated ranked list of washers is a subset of the multiple washer users and wherein the subset is determined based on a washer score threshold value.

5. The system of claim 1, wherein the first delivery service request comprises scheduling a courier to retrieve from the first user and deliver to the first washer user, the one or more laundry bags associated with the laundry service order.

6. The system of claim 5, wherein the mobile application is further configured for:

scanning, via a client device of the first washer user, the one or more laundry bags delivered by courier.

7. The system of claim 1, wherein the mobile application is further configured to perform the operations of:

selecting, via a washer user interface, a first load associated with a first laundry bag;

scanning, by the first washer user, a first washing machine at the first laundry facility, wherein the first washing machine is loaded with the first load; and initiating a first washing cycle on the first washing machine.

8. The system of claim 1, wherein the mobile application is further configured to perform the operations of:

selecting, via a washer user interface, a second load associated with a first laundry bag;

scanning, by the first washer user, a second washing machine at the first laundry facility, wherein the second washing machine is loaded with the second load;

initiating a second washing cycle on the second washing machine; and notifying the first washer of the completion of the first washing cycle and second washing cycle.

9. The system of claim 8, wherein the mobile application is further configured to perform the operations of:

scanning, by the first washer user, the first washing machine containing the first load followed by scanning of a first dryer, wherein the first load is transferred from the first washing machine to the first dryer and wherein a first drying cycle is initiated on the first dryer;

scanning, by the first washer user, the second washing machine containing the second load followed by scanning of a second dryer, wherein the second load is transferred from the second washing machine to the second dryer and wherein a second drying cycle is initiated on the second dryer; and notifying the first washer user of the completion of the first drying cycle and the second drying cycle.

10. The system of claim 9, wherein the mobile application is further configured to perform the operations of:

scanning, by the first washer, the first dryer containing the first load followed by scanning the first laundry bag, wherein the first load is removed from the first dryer and folded before being placed in the first laundry bag;

scanning, by the first washer user, the second dryer containing the second load followed by scanning the first laundry bag, wherein the second load is removed from the second dryer and folded before being placed in the first laundry bag;

transmitting, to the one or more servers, a completion notification, wherein the completion notification further comprises a second delivery service request, wherein the second delivery service request comprises scheduling a courier to retrieve from the first washer user and deliver to the first user, the one or more laundry bags associated with the laundry service order.

11. A method to manage a laundry service platform, comprising the operations of:

receiving a laundry service order associated with one or more laundry bags, the service order being received from a client device of a first user;

determining a washer score for multiple washer users;

generating a ranked list of the multiple washer users;

generating an order offer notification for each of the washer users in the ranked list of washers;

transmitting to multiple client devices of the washer users in the ranked list an order offer notification;

receiving, from one of the multiple client devices, an order acceptance notification, from a first washer user; and generating a first delivery service request to the first washer user.

12. The method of claim 11, wherein each of the one or more laundry bags holds one or more loads of laundry and wherein each of the one or more laundry bags comprises a unique identifier.

13. The system of claim 11, wherein the washer score is determined based on a distance between the first user and a particular washer user and a delivery time corresponding to transporting the one or more laundry bags associated with the laundry service order from the first user to the particular washer user.

14. The system of claim 11, wherein the generated ranked list of washers is a subset of the multiple washer users and wherein the subset is determined based on a washer score threshold value.

15. The system of claim 11, wherein the first delivery service request comprises scheduling a courier to retrieve from the first user and deliver to the first washer user, the one or more laundry bags associated with the laundry service order.

16. The method of claim 15, further comprising the operations of:

scanning, via a client device of the first washer user, the one or more laundry bags delivered by courier.

17. The method of claim 11, further comprising the operations of:

selecting, via a washer user interface, a first load associated with a first laundry bag;

scanning, by the first washer user, a first washing machine at the first laundry facility, wherein the first washing machine is loaded with the first load; and initiating a first washing cycle on the first washing machine.

18. The method of claim 11, further comprising the operations of:

selecting, via a washer user interface, a second load associated with a first laundry bag;

scanning, by the first washer user, a second washing machine at the first laundry facility, wherein the second washing machine is loaded with the second load;

initiating a second washing cycle on the second washing machine; and notifying the first washer of the completion of the first washing cycle and second washing cycle.

19. The method of claim 18, further comprising the operations of:

scanning, by the first washer user, the first washing machine containing the first load followed by scanning of a first dryer, wherein the first load is transferred from the first washing machine to the first dryer and wherein a first drying cycle is initiated on the first dryer;

scanning, by the first washer user, the second washing machine containing the second load followed by scanning of a second dryer, wherein the second load is transferred from the second washing machine to the second dryer and wherein a second drying cycle is initiated on the second dryer; and notifying the first washer user of the completion of the first drying cycle and the second drying cycle.

20. The method of claim 19, further comprising the operations of:

scanning, by the first washer, the first dryer containing the first load followed by scanning the first laundry bag, wherein the first load is removed from the first dryer and folded before being placed in the first laundry bag;

scanning, by the first washer user, the second dryer containing the second load followed by scanning the first laundry bag, wherein the second load is removed from the second dryer and folded before being placed in the first laundry bag; and transmitting a completion notification, wherein the completion notification further comprises a second delivery service request, wherein the second delivery service request comprises scheduling a courier to retrieve from the first washer user and deliver to the first user, the one or more laundry bags associated with the laundry service order.

* * * * *